US006444412B1

(12) United States Patent
Clarke et al.

(10) Patent No.: US 6,444,412 B1
(45) Date of Patent: Sep. 3, 2002

(54) PHOTOGRAPHIC ELEMENT WITH DYE-FORMING COUPLER AND STABILIZING COMPOUND

(75) Inventors: David Clarke; Llewellyn J. Leyshon, both of Watford; Christopher P. Moore, Harrow, all of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/934,107

(22) Filed: Aug. 21, 2001

(30) Foreign Application Priority Data

Sep. 20, 2000 (GB) ..... 0023089

(51) Int. Cl.[7] ..... G03C 11/00

(52) U.S. Cl. ..... 430/372; 430/383; 430/543; 430/546; 430/551; 430/553; 430/554; 430/555; 430/557; 430/558

(58) Field of Search ..... 430/372, 383, 430/543, 551, 553, 554, 535, 558, 557, 546

(56) References Cited

U.S. PATENT DOCUMENTS

| | | | | |
|---|---|---|---|---|
| 2,964,499 A | | 12/1960 | Weigel et al. | |
| 4,503,243 A | | 3/1985 | Spivack et al. | |
| 4,582,870 A | * | 4/1986 | Spivack et al. | 524/262 |
| 4,727,015 A | * | 2/1988 | Moore | 430/377 |
| 4,749,645 A | | 6/1988 | Goddard et al. | |
| 5,017,465 A | | 5/1991 | Nishijima | |
| 6,004,738 A | | 12/1999 | Lau et al. | |

* cited by examiner

*Primary Examiner*—Geraldine Letscher
(74) *Attorney, Agent, or Firm*—Arthur E. Kluegel

(57) ABSTRACT

The invention relates to a photographic element comprising a light sensitive silver halide emulsion layer having associated therewith one or more dye-forming couplers and a stabilizer compound of formula (I):

(I)

wherein $R_1$ and $R_2$ are independently selected from hydrogen or an unsubstituted or substituted alkyl, aryl, alkoxy, aryloxy or amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene rings or heteroaromatic ring systems; or X forms, together with substituents ortho to X on the arene rings or heteroaromatic ring systems, a fused unsubstituted or substituted 5-, 6- or 7-membered ring, which may contain one or two heteroatoms selected from nitrogen, oxygen and sulfur.

The stabilizer is used to enhance the image stability of the dye formed from a cyan, magenta or yellow dye-forming coupler without significantly degrading other photographic properties.

16 Claims, No Drawings

PHOTOGRAPHIC ELEMENT WITH DYE-FORMING COUPLER AND STABILIZING COMPOUND

FIELD OF THE INVENTION

This invention relates to conventional and to redox-amplified silver halide colour photographic materials and more particularly to such materials which contain a dye-forming coupler in combination with certain non-imaging compounds. The resulting dyes exhibit an exceptional combination of photographic properties, especially in regard to hue and stability. The application is related to UK application number 0023093.8 of even date herewith.

BACKGROUND OF THE INVENTION

In a silver halide photographic element, a colour image is formed when the element is exposed to light and then subjected to colour development, generally with a primary aromatic amine developer. Colour development results in imagewise reduction of silver halide and production of oxidized developer. Oxidized developer reacts with one or more incorporated dye-forming couplers to form an imagewise distribution of dye.

In any polychromatic chromogenic photographic material it is desirable that the dyes so formed should have certain properties. For instance the dyes should be bright in colour, absorbing light in the appropriate spectral region, with very little secondary absorption so that good colour reproducibility is obtained. The dyes that are formed by any colour coupler during processing have a tendency to fade over time as a result of exposure to light, heat, humidity and oxygen. Since the three image dyes may not fade at the same rate, an apparent change in image colour may result. It is thus paramount that the formed photographic dye images should be resistant towards fading by heat, humidity and light.

When the dye images are formed in silver halide photographic materials from the combination of oxidized developer and an incorporated coupler, certain restrictions are placed on the properties of the coupler. For instance, the coupler should produce a dye which has the aforementioned desirable properties and the efficiency of the dye-forming reaction must be high. Additionally, the coupler must be easily dispersible, must itself be resistant towards the deleterious effects of light, heat and humidity and must have a low propensity to form fog.

It is well known in the art of coupler chemistry that when a functionality is incorporated into a molecule to achieve one of the aforementioned desirable properties (such as high dye light stability), quite often one or more of the other desirable properties of the photographically formed dye (such as its hue) is affected adversely. It is very difficult to obtain a coupler which manifests all or even most of the aforementioned desirable properties. For example, dyes formed by diacylaminophenolic cyan couplers, whilst exhibiting excellent resistance to fading by heat and humidity, are especially deficient in their ability to withstand the effects of light and their absorption bands tend to lie at shorter wavelengths than is desirable, particularly for colour paper applications.

It is known that the absorption characteristics of an image dye can be modified by the chemical environment in which the dye is situated. For example, U.S. Pat. Nos. 4,952,487 and 5,376,519 and JP 59171953 teach the use of certain phenolic coupler solvents to shift the dye absorption band to longer wavelengths. Additionally, the hue of the dye can also be manipulated by incorporating certain functionalities into the molecular structure of the coupler, and these techniques can also result in the enhancement of other features such as coupling reactivity or image dye light stability.

Another method of improving image dye light stability is by the incorporation of certain stabilizing addenda into the coupler dispersion. Such stabilizing addenda can be used alone or in combination. For example, U.S. Pat. No. 6,004,738 teaches that the aforementioned diacylaminophenolic cyan image dyes can be stabilized by the use of heterocyclic phosphorus derivatives of certain bis-phenols, especially when these are used in combination with phenolic coupler solvents. In particular, UK Application number 0023093.8 of even date herewith describes the selection of meta and/or para fluoro- and fluoroalkyl-substituted diacylaminophenolic cyan image-forming couplers for further improvement in light stability.

The use of the same phosphorus heterocycles to stabilize yellow image dyes against deterioration by light is taught in U.S. Pat. No. 4,749,645, while UK Patent No. 1,267,287 and U.S. Pat. No. 4,782,011 teach, respectively, the benefits of their unsubstituted parent bis-phenols and mono-blocked derivatives thereof as stabilizers of these dyes. Furthermore, EP-A-0 310 551 and EP-A-0 310 552 describe the use of phenolic antioxidants in combination with thiane derivatives and yellow dye-forming couplers for improved light stability.

U.S. Pat. Nos. 5,017,465 and 5,082,766 and German Published Patent Application DTOS 4,307,194 describe the use of certain cyclic sulfur and/or oxygen-containing stabilizers with pyrazoloazole magenta dye forming couplers to improve their image dye stability.

Nevertheless, there remains a continuing need to seek coupler formulations with improved performance because, quite often, one or more of the other desirable properties of the photographically formed dye (such as its hue) can be affected adversely by these artifices.

Heterocyclic silicon-blocked bis-phenols have been disclosed by S. D. Pastor in J. Org. Chem. 1984,49, 1927 and their use as stabilizers for plastics described in EP-A-0 114,148. The use of such compounds to stabilise dye-forming couplers has not been disclosed therein.

PROBLEM TO BE SOLVED BY THE INVENTION

The problem to be solved is the provision of a photographic element comprising a dye-forming formulation which provides an image dye of good hue and which exhibits exceptional stability against the effects of light without significant degradation of other photographic properties.

SUMMARY OF THE INVENTION

In accordance with the embodiment of the invention there is provided a photographic element comprising a light sensitive silver halide emulsion layer having associated therewith one or more dye-forming couplers and a stabilizer compound of formula (I):

(I)

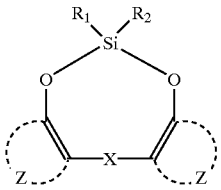

wherein $R_1$ and $R_2$ are independently selected from hydrogen or an unsubstituted or substituted alkyl, aryl, alkoxy, aryloxy or substituted amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

The element of the invention provides an image dye of good hue, exhibiting exceptional stability against the effects of light, without significant degradation of other photographic properties.

DETAILED DESCRIPTION OF THE INVENTION

The combination of the invention is generally as described in the Summary of the Invention.

The stabilizer of the invention is the bisphenol derivative of formula (I):

(I)

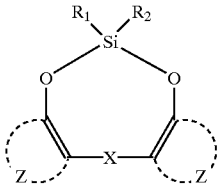

wherein $R_1$ and $R_2$ are independently selected from hydrogen or an unsubstituted or substituted alkyl, aryl, alkoxy, aryloxy or substituted amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

Each Z represents the atoms necessary to form an arene or heterocyclic ring, such as a naphthalene, pyridine or quinoline ring, but preferably the atoms complete a phenyl ring, which may be substituted.

X is any linking group that presents a single atom between the arene or heteroaromatic ring systems and is preferably a divalent linking group selected from —CR'R"—, —NR—, —$S(O)_q$— and —O—, wherein R is an unsubstituted or substituted alkyl or aryl group, R' and R" are independently selected from hydrogen and an unsubstituted or substituted alkyl or aryl group and q is 0, 1 or 2. Alternatively X may complete, together with substituents ortho to X on the arene or heteroaromatic ring systems, a fused 5-, 6 - or 7-membered fused ring system which may be substituted or contain one or two heteroatoms selected from nitrogen, oxygen and sulfur. However X is preferably a sulfur atom or an oxygen atom or more preferably an unsubstituted or substituted methylene group.

In a preferred embodiment the bisphenol stabilizer has the formula (IA)

(IA)

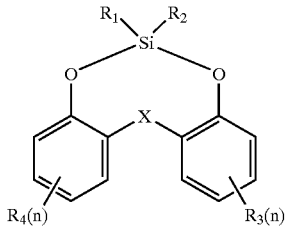

wherein $R_1$ and $R_2$ are as hereinbefore defined;

$R_3$ and $R_4$ are each independently selected from halogen or an unsubstituted or substituted alkyl, aryl, alkoxy, aryloxy, COOR or CONR'R" group, where R, R' and R" are as hereinbefore defined and each n is independently an integer from 1 to 4;

X is a single bond or a linking group having a single atom which connects the phenyl rings; or X forms together with $R_3$ and $R_4$, when in the ortho position, a fused unsubstituted or substituted 5-, 6- or 7-membered ring, which may contain one or two heteroatoms selected from nitrogen, oxygen and sulfur.

$R_1$ and $R_2$ are the same or different and are preferably selected from hydrogen or unsubstituted or substituted alkyl or aryl groups, or they may combine with the silicon atom to form a 5 - or 6-membered ring, which may contain an oxygen atom.

Although $R_3$ and $R_4$ may be the same or different, conveniently they are the same for ease of synthesis and are preferably selected from unsubstituted or substituted alkyl, aryl or alkoxy groups or halogen atoms, most preferably unsubstituted alkyl groups. Conveniently each n is 2 and the substituents are preferably in the ortho and para positions.

In a more preferred embodiment the stabilizer has the formula (IB)

(IB)

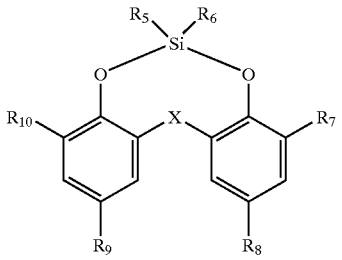

wherein:

$R_5$ and $R_6$ are independently selected from hydrogen, and unsubstituted or substituted alkyl or aryl groups, or they may combine with the silicon atom to form a 5 - or 6-membered ring, which may contain an oxygen atom;

$R_7$, $R_8$, $R_9$ and $R_{10}$ are independently selected from hydrogen or halogen atoms or unsubstituted or substituted alkyl, aryl or alkoxy groups, preferably alkyl groups and especially secondary or tertiary alkyl groups.

Although $R_7$, $R_8$, $R_9$ and $R_{10}$ may be the same or different, conveniently $R_7$ and $R_{10}$ are the same for ease of synthesis, especially alkyl groups, as are $R_8$ and $R_9$, which are especially halogen atoms or alkyl groups.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

Specific examples of stabilizers of formula (I) include the following although the invention is not to be construed as limited thereto:

(ST1)

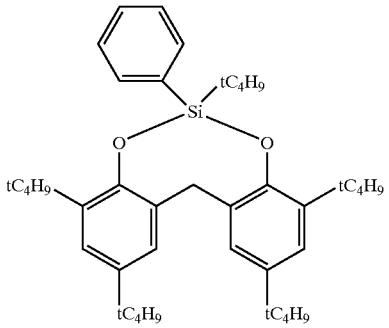

-continued (ST2)

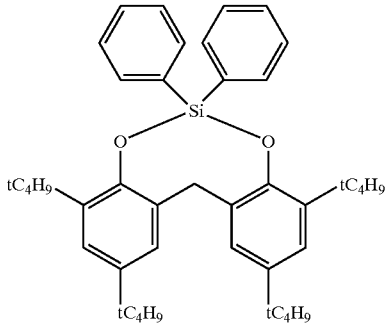

(ST3)

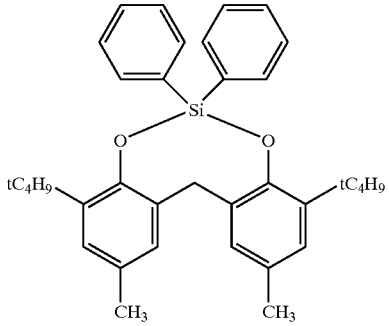

(ST4)

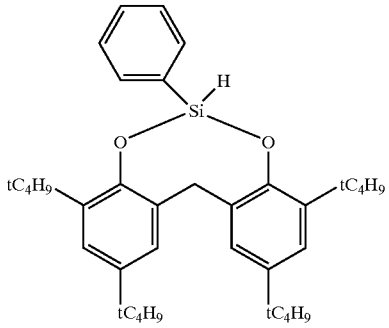

(ST5)

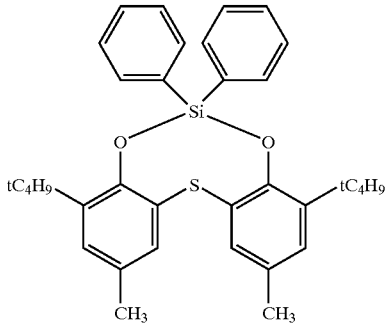

(ST6)

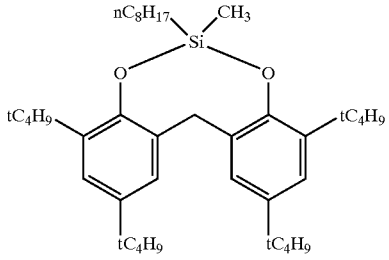

-continued
(ST7)
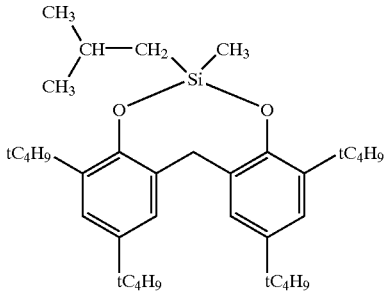
(ST8)
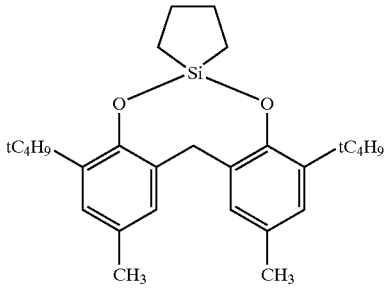
(ST9)
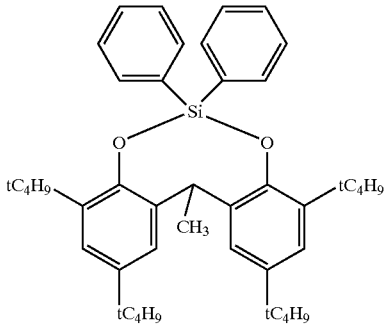
(ST10)
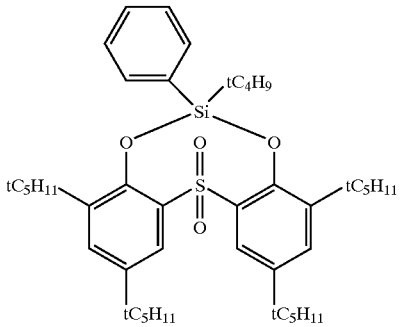
(ST11)
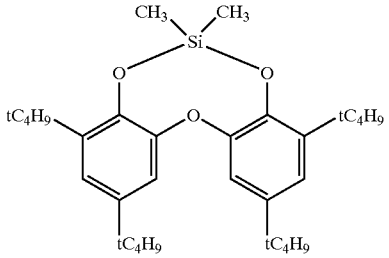
-continued
(ST12)
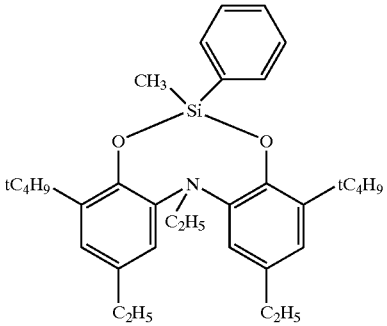
(ST13)
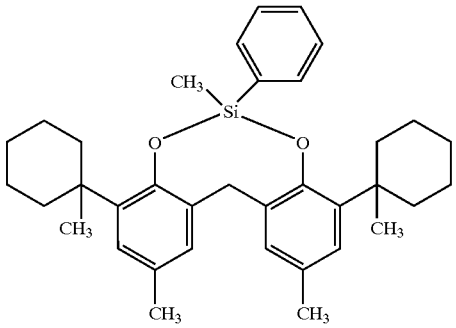
(ST14)
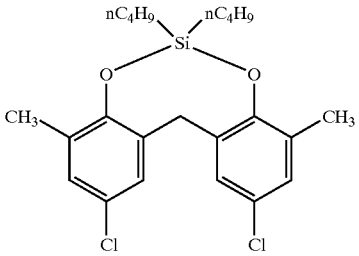
(ST15)
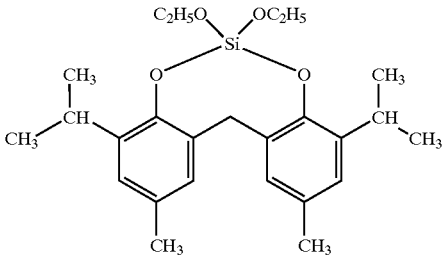
(ST16)
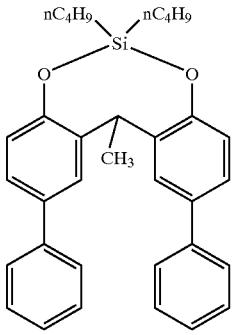

-continued
(ST17)
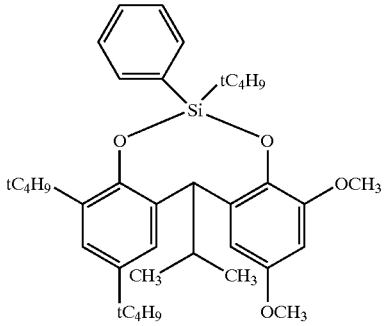
(ST18)
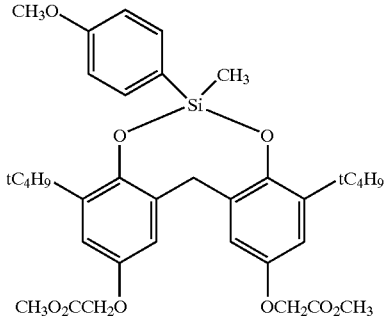
(ST19)
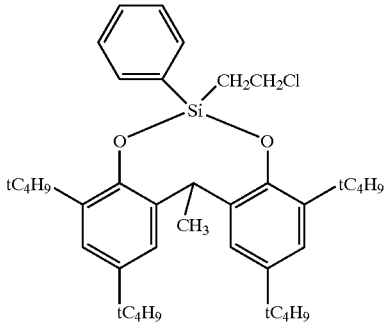
(ST20)
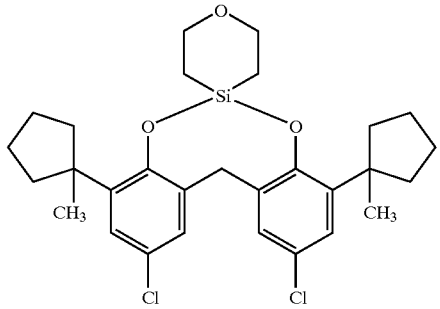
(ST21)
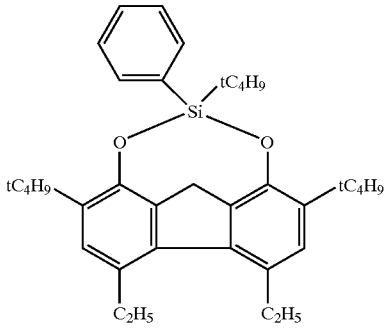
-continued
(ST22)
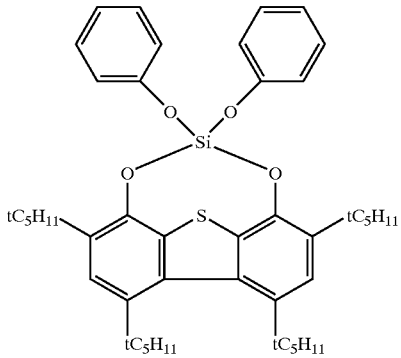
(ST23)
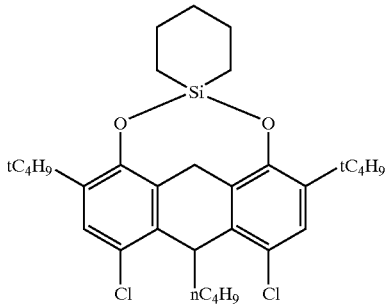
(ST24)
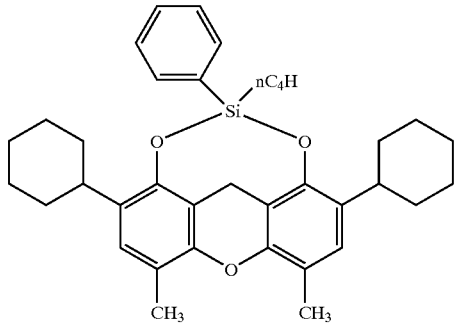
(ST25)
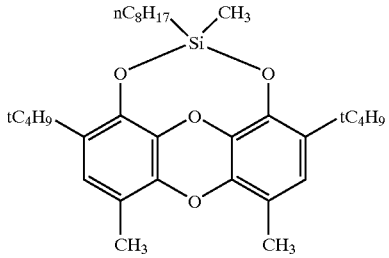
(ST26)
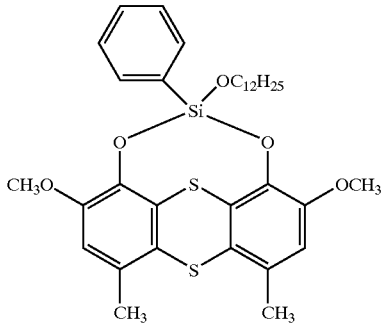

-continued (ST27)

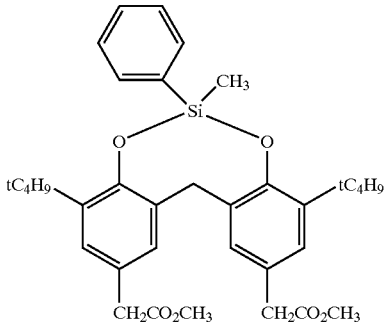

(ST28)

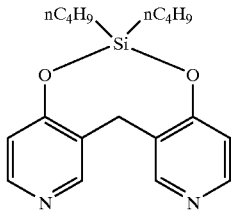

(ST29)

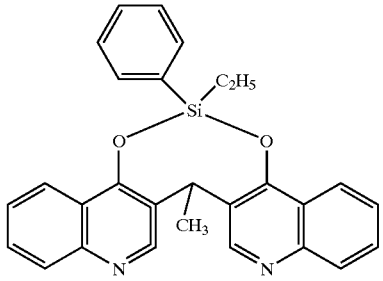

(ST30)

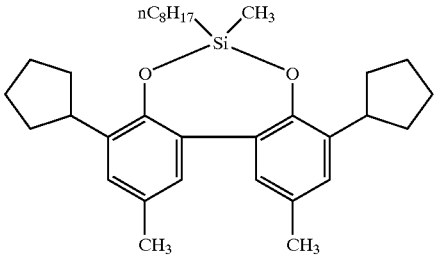

The invention may be practised with a stabilizer compound of formula (I) to enhance the image stability of the dye formed from a cyan, magenta or yellow dye-forming coupler.

Couplers that form cyan dyes upon reaction with oxidized colour developing agents are typically phenols, naphthols or pyrazoloazoles, described in such representative patents and publications as U.S. Pat. Nos. 2,367,531; 2,423,730; 2,474,293; 2,772,162; 2,895,826; 3,002,836; 3,034,892; 3,041,236; 4,333,999 and 4,883,746; European Patent Application Nos. 0 544 322; 0 556 700; 0 556 777; 0 565 096; 0 570 006 and 0 574 948 and "Farbkuppler-eine Literature Übersicht," published in Agfa Mitteilungen, Band III, pp. 156–175 (1961).

One well-known type of cyan dye-forming coupler, which may be used with advantage either alone or in the presence of another cyan dye-forming coupler, is a phenolic cyan dye-forming coupler of formula (I):

(II)

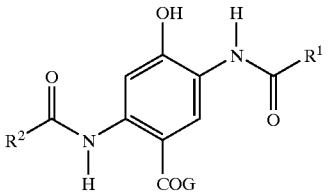

wherein $R^1$ and $R^2$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent.

When $R^1$ and/or $R^2$ are an amino or alkoxy group they may, for example, be substituted with a halogen, aryloxy or alkyl- or aryl-sulfonyl group. Suitably, however, $R^1$ and $R^2$ are independently selected from an unsubstituted or substituted alkyl or aryl group or a 5–10 membered heterocyclic ring, such as a pyridyl, morpholino, imidazolyl or pyridazolyl group.

However $R^1$ is preferably an unsubstituted or substituted aryl or heterocyclic ring substituted, in particular, with an electron-withdrawing substituent (Hammett's sigma para value greater than 0) in a position meta and/or para to the amido group. Hammett's sigma values may be obtained from "Substituent constants for Correlation Analysis in Chemistry and Biology" by Hansch and Leo, available from Wiley and Sons, New York, N.Y. (1979).

For example the aryl or heterocyclic ring may be substituted with a cyano, chloro, fluoro, bromo, iodo, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, aryl, alkyl, alkoxy, aryloxy, nitro, alkyl- or aryl-ureido or alkyl- or aryl-carbamoyl group, any of which may be further substituted. Preferred groups are halogen, cyano, alkoxycarbonyl, alkylsulfamoyl, alkylsulfonamido, alkylsulfonyl, carbamoyl, alkylcarbamoyl or alkylcarbonamido. When $R^2$ is an aryl or heterocyclic ring it may be similarly substituted.

Suitably, $R^1$ is a 4-chlorophenyl, 3,4-dichlorophenyl, 3,4-difluorophenyl, 4-cyanophenyl, 3-chloro-4-cyanophenyl, pentafluorophenyl, or a 3 - or 4-sulfonamidophenyl group.

$R^2$ is more preferably an alkyl group substituted, for example, with a halogen, alkyl, aryloxy or alkyl- or aryl-sulfonyl group, which may be further substituted. When $R^1$ is an alkyl group it may be similarly substituted.

In particular $R^2$ may be a group of the formula:

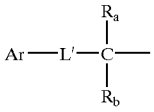

wherein

Ar is an unsubstituted or substituted aryl group, L' is a divalent linking group such as —O—, —SO—, or —$SO_2$—, and $R_a$ and $R_b$ are independently H or an alkyl group. In one embodiment, $R_a$ is an alkyl group, $R_b$ is H, and L' is —$SO_2$—.

More particularly $R^2$ is the group

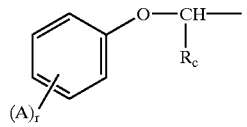

wherein each A is independently a substituent with at least one A being an alkyl- or aryl-sulfonamido or -sulfamoyl group, r is 1 or 2, and $R_c$ is hydrogen or an alkyl group. Preferably there is a halogen in the position ortho to the phenolic oxygen atom.

COG is hydrogen or a coupling-off group, suitably a halogen atom or a group linked by an atom of sulfur, oxygen or nitrogen. Chloro groups are conveniently employed.

Specific examples of couplers of formula (II) include the following although the invention is not to be construed as limited thereto.

C-1

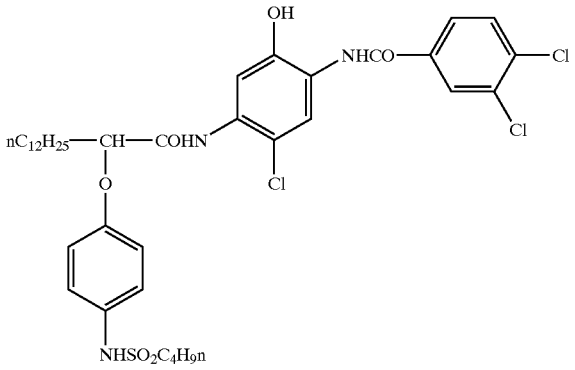

C-2

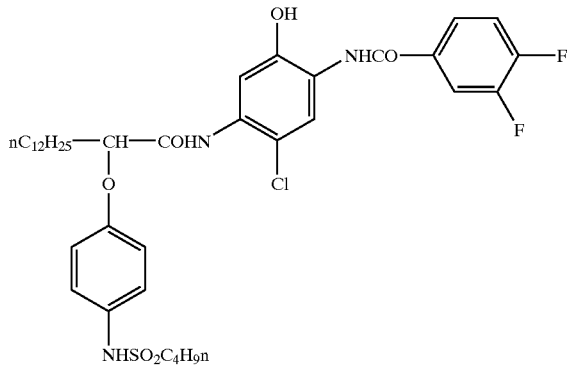

C-3

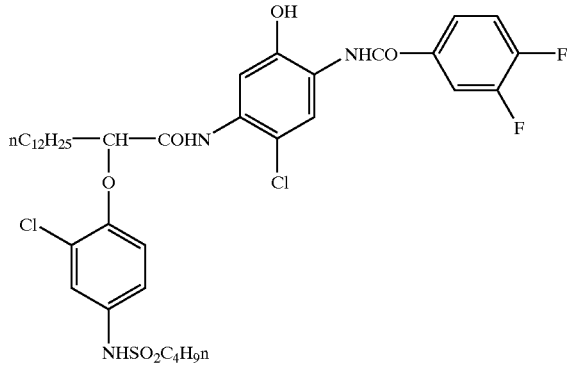

-continued

C-4

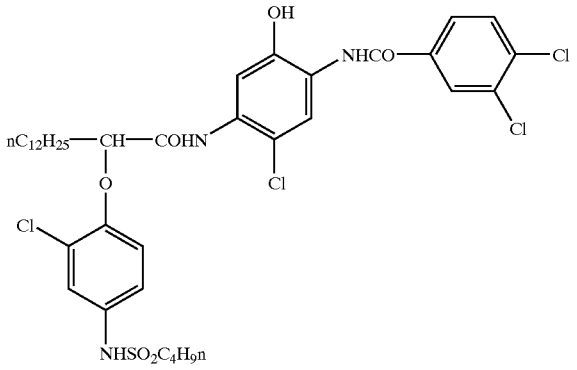

C-5

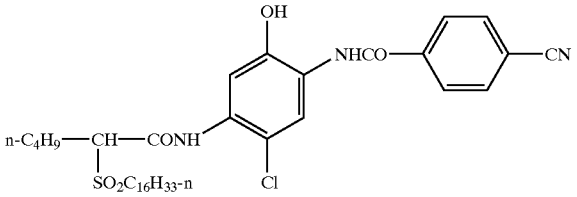

C-6

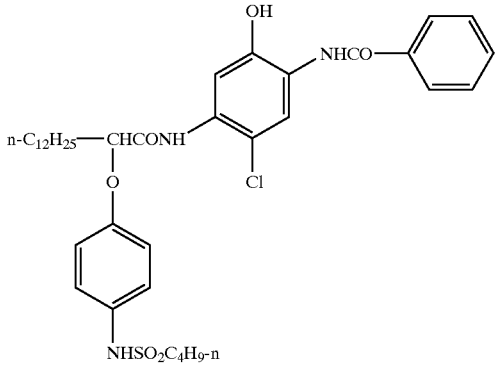

C-7

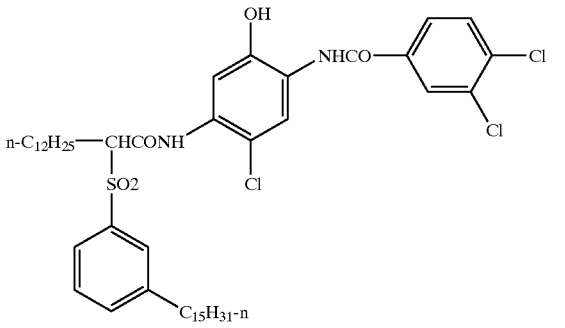

-continued
C-8
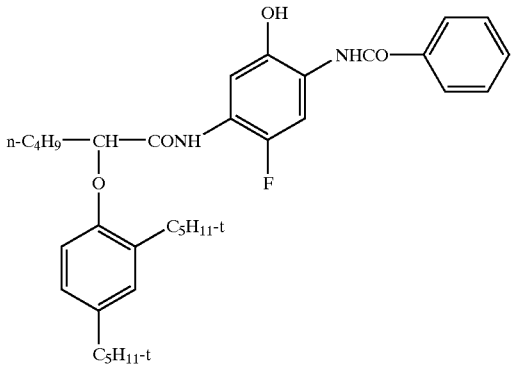
C-9
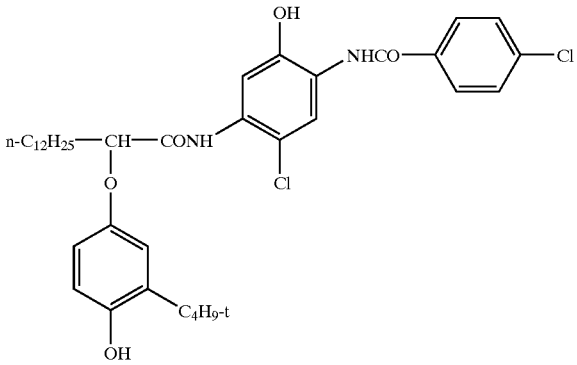
C-10
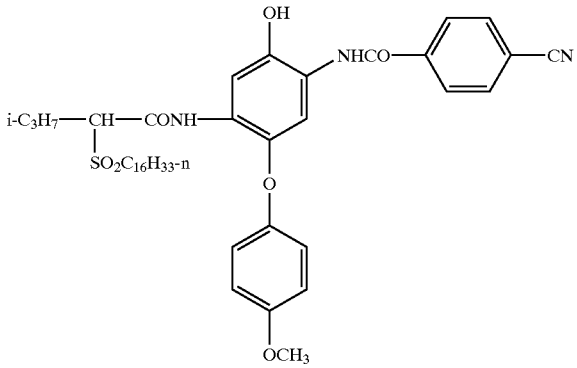
C-11
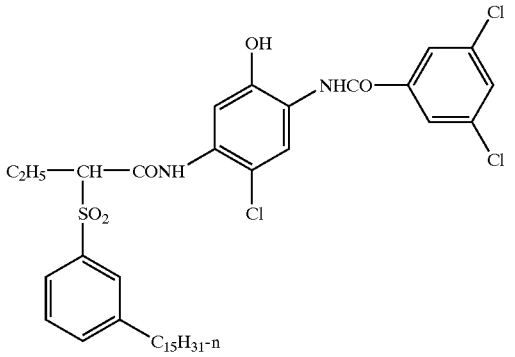
-continued
C-12
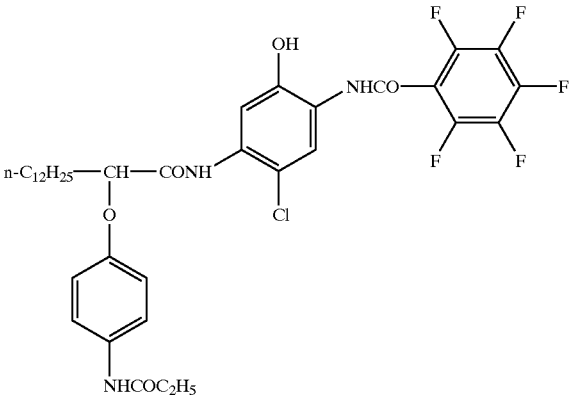
C-13
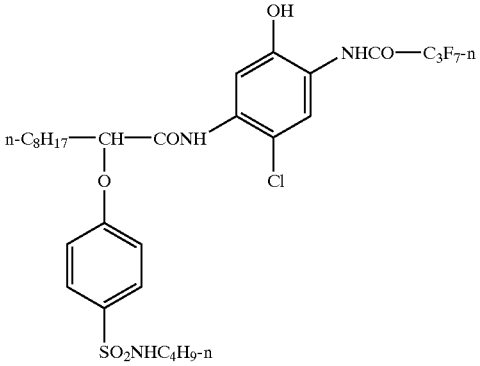
C-14
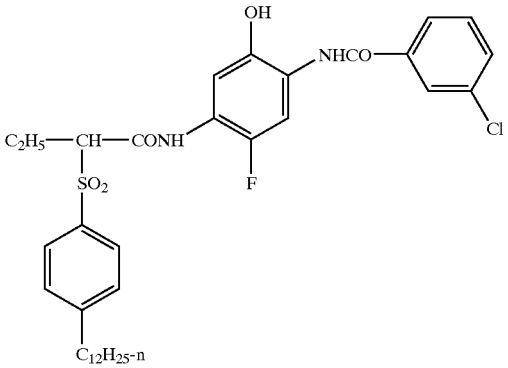
C-15
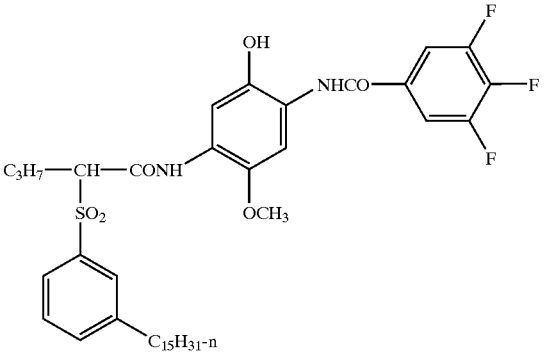

-continued
C-16
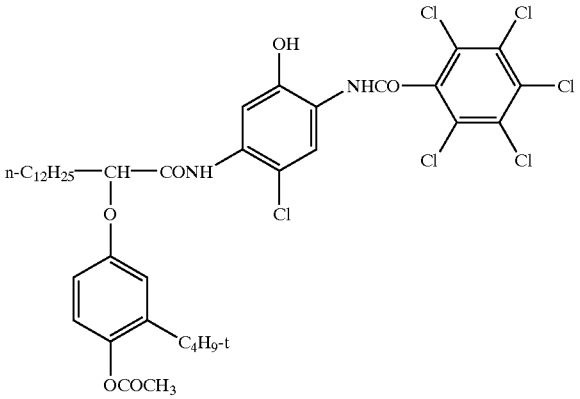
C-17
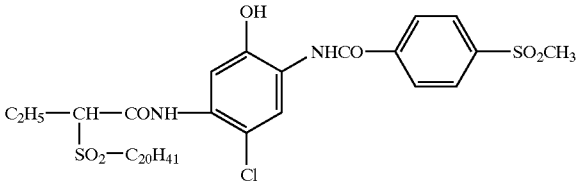
C-18
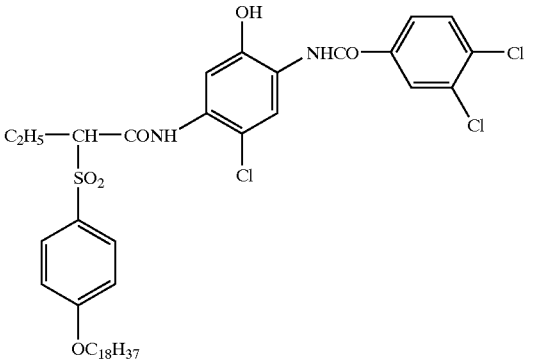
C-19
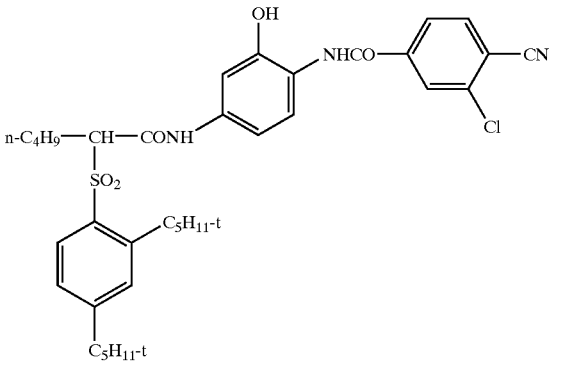
C-20
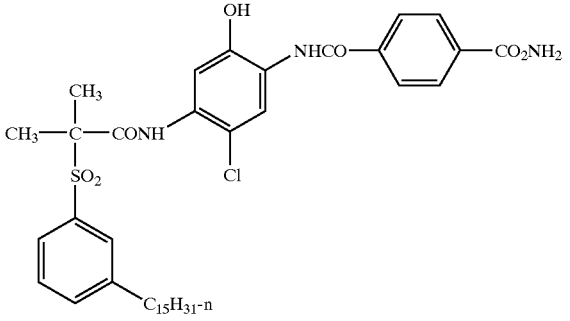
C-21
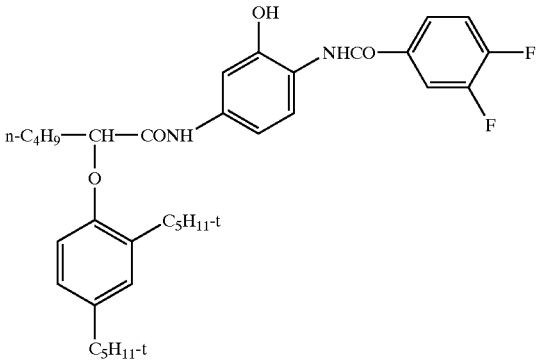
C-22
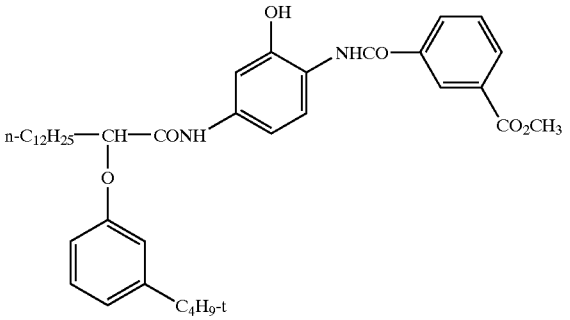
C-23
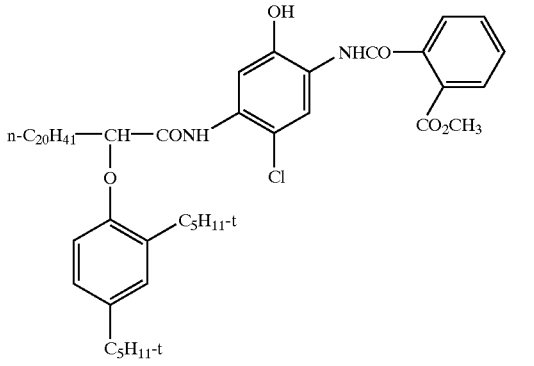

-continued

C-24

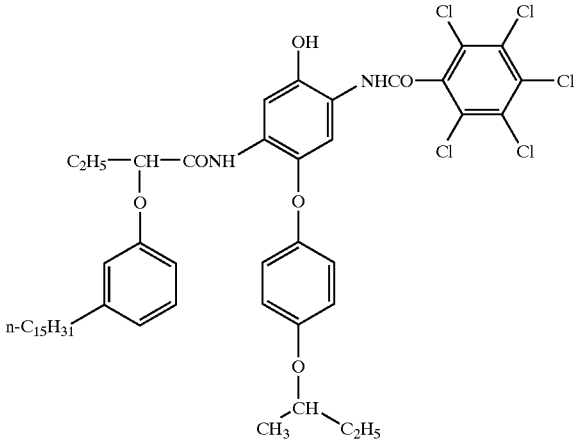

C-25

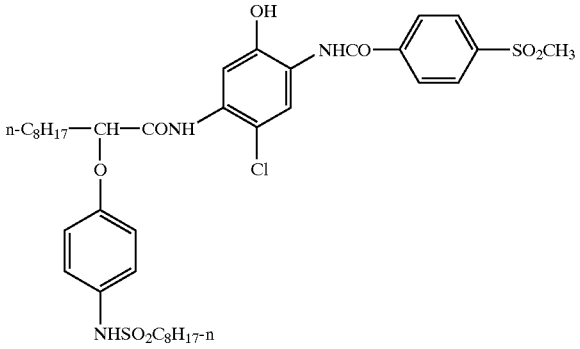

C-26

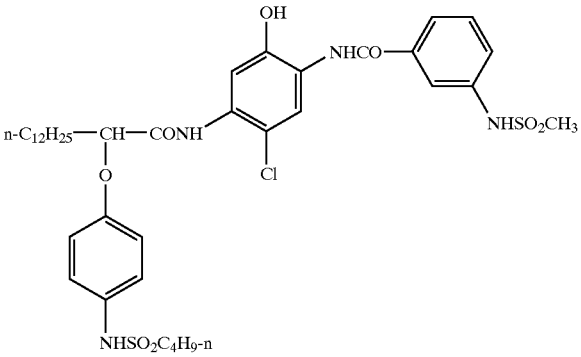

C-27

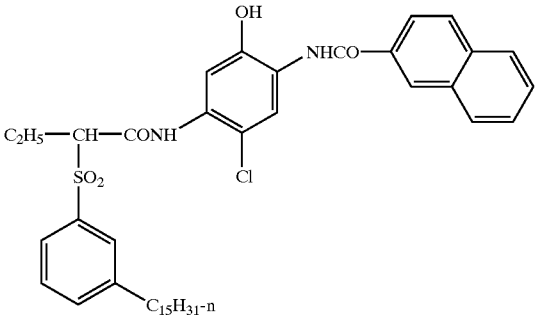

-continued

C-28

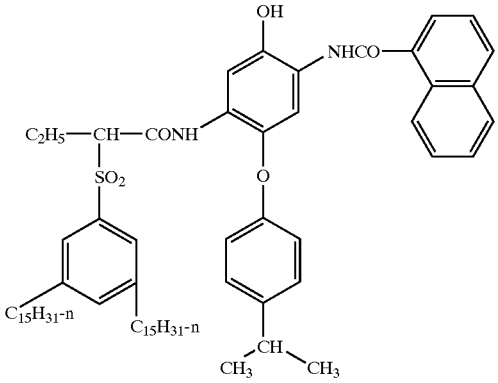

C-29

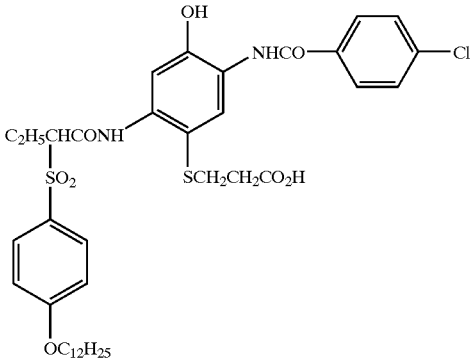

Couplers that form magenta dyes upon reaction with oxidized colour developing agents are typically pyrazolones, pyrazoloazoles, or pyrazolo-benzimidazoles as described in such representative patents and publications as U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine Literature Übersicht," published in Agfa Mitteilungen, Band III, pp. 126–156 (1961). Activated propenes for use as magenta couplers have also been disclosed in U.S. Pat. No. 5,443,945.

A magenta dye-forming coupler, which may be used with advantage in the present invention either alone or in the presence of another magenta dye-forming coupler, is preferably a coupler of formula (III) having either of the structures (IIIA) or (IIIB):

(IIIA)

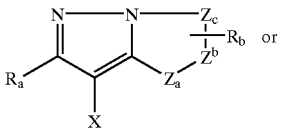

(IIIB)

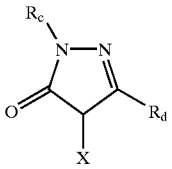

wherein $R_a$ and $R_b$ independently represent hydrogen or a substituent; $R_c$ is a substituent (preferably an aryl group);

$R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of couplers of formula (III) include the following although the invention is not to be construed as limited thereto:

M-1

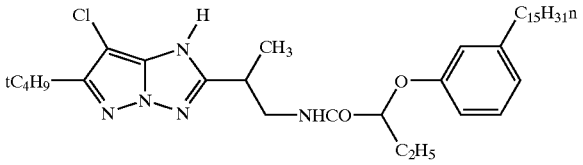

M-2

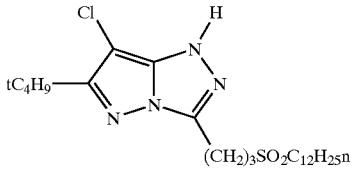

M-3

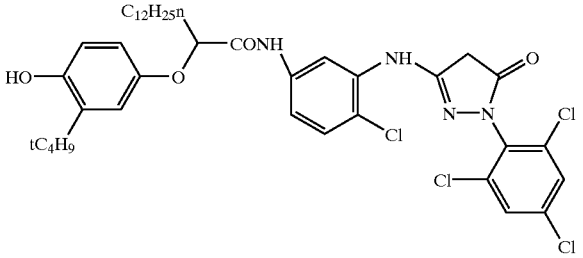

M-4

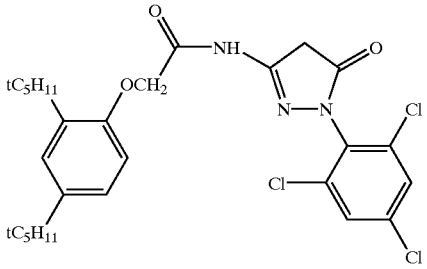

M-5

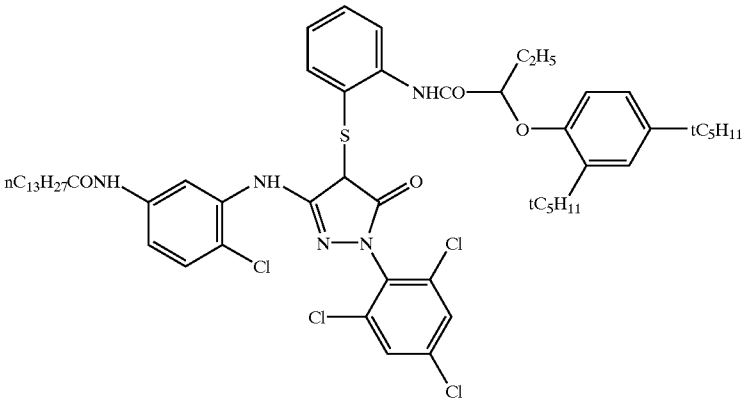

M-6

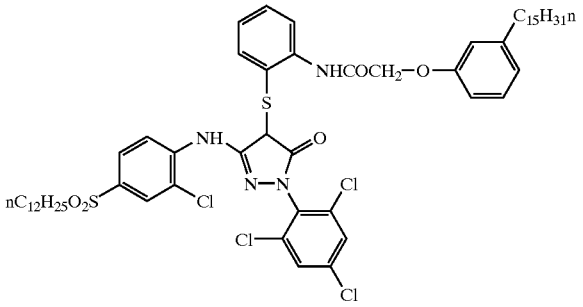

M-7

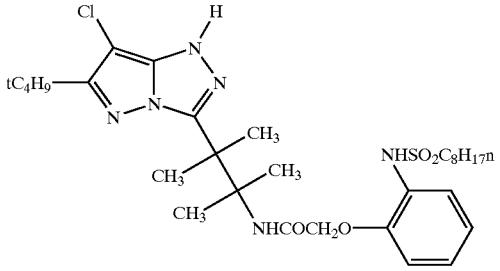

-continued

M-8

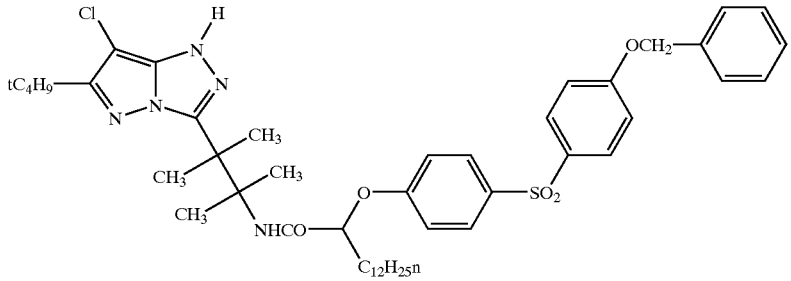

M-9

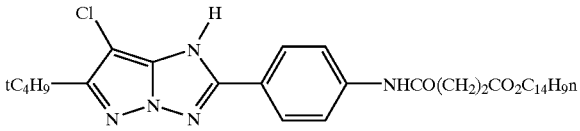

M-10

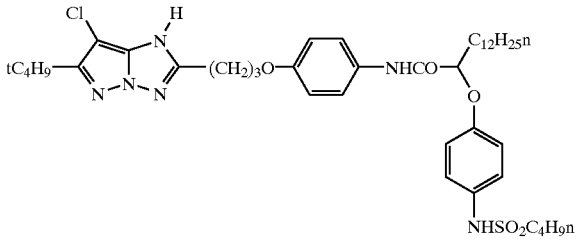

M-11

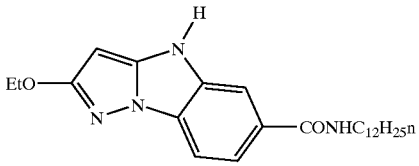

M-12

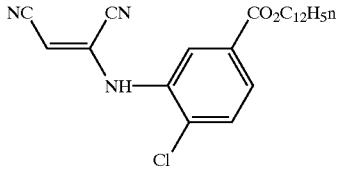

Couplers that form yellow dyes upon reaction with oxidized colour developing agent are typically open chain ketomethylene compounds and are described in such representative patents and publications as: "Farbkuppler-eine Literature Übersicht," published in Agfa Mitteilungen; Band III; pp. 112–126 (1961); as well as U.S. Pat. Nos. U.S. Pat. Nos. 2,875,057; 2,407,210; 3,265,506; 2,298,443; 3,048,194; 3,447,928; 3,960,570; 4,022,620; 4,910,126; 4,443,536; 5,238,803 and 5,340,703 and in European Patent Application Nos. 0 482 552; 0 510 535; 0 524 540 and 0 543 367.

In particular the invention may further be used to provide a means of improving the resistance to light of a yellow image from a yellow coupler of formula (IV):

(IV)

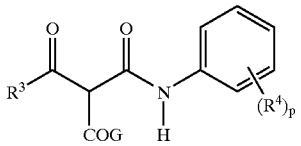

wherein $R^3$ is selected from an unsubstituted or substituted alkyl or aryl group or a 5–10 membered heterocyclic ring which contains one or more heteroatoms selected from nitrogen, oxygen and sulfur, which ring is unsubstituted or substituted;

COG is a hydrogen atom or a group which can be split off by the reaction of the coupler with an oxidized colour developing agent;

$R^4$ is a substituent and p is 1 to 5.

$R^3$ is preferably an alkyl or aryl group and especially a tertiary alkyl group, such as t-butyl. Each $R^4$ may be independently selected from those substituents as hereinbefore defined for the aryl or heterocyclic ring for $R^1$ in the compounds of formula (II). Preferred groups for $R^4$ are halogen, cyano, alkoxy, aryloxy, alkoxycarbonyl, alkylsulfamoyl, alkylsulfonamido, alkylsulfonyl, carbamoyl, alkylcarbamoyl or alkylcarbonamido.

Specific examples of couplers of formula (IV) include the following although the invention is not to be construed as limited thereto.

Y-1

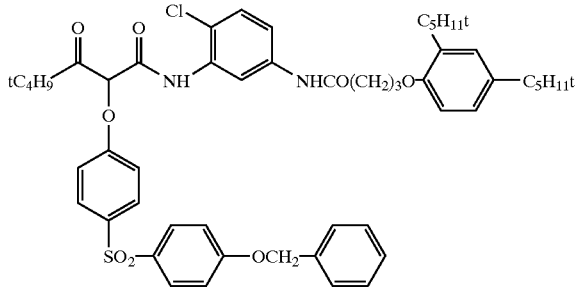

-continued
Y-2
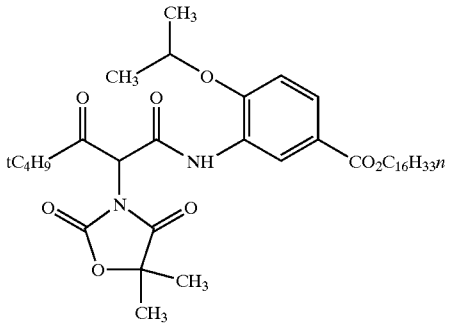
Y-3
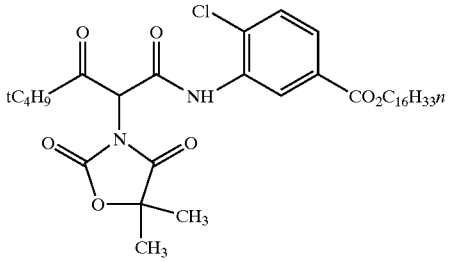
Y-4
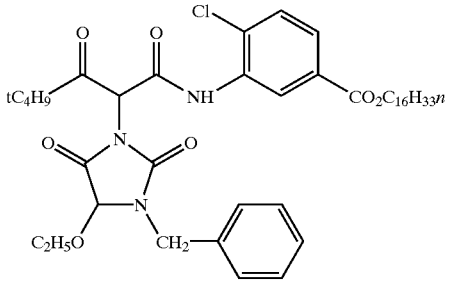
Y-5
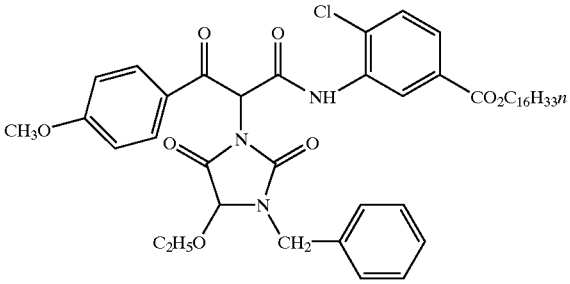
-continued
Y-6
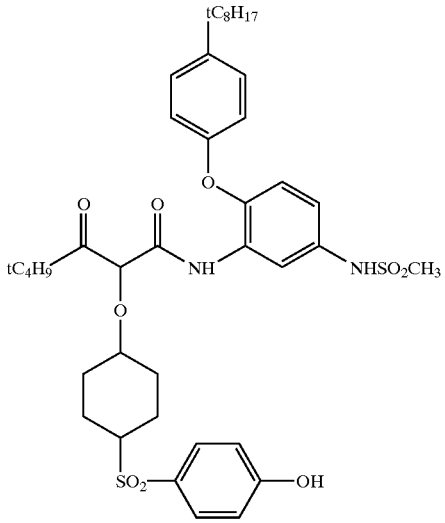
Y-7
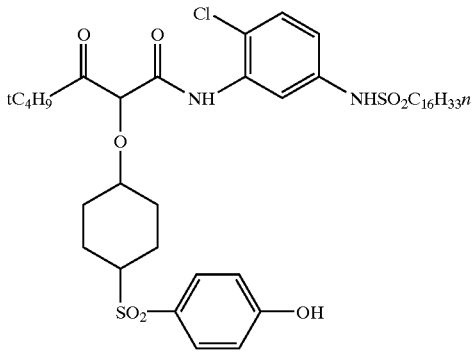
Y-8
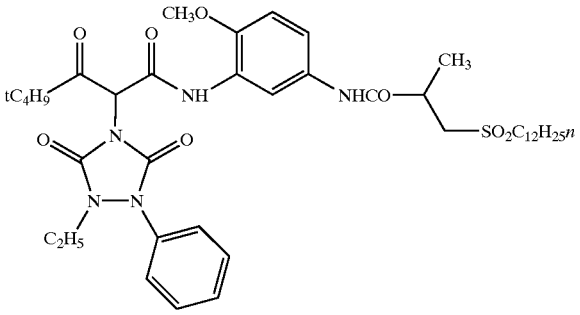
Y-9
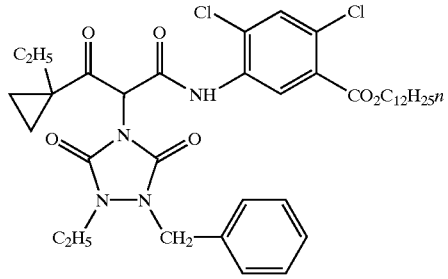

-continued

Y-10

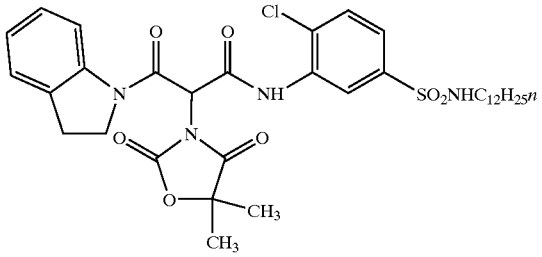

Y-11

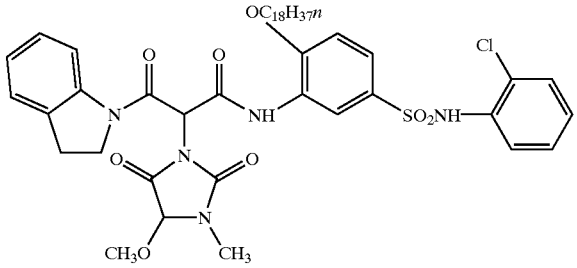

The stabilizer and couplers for use in the invention can be incorporated into the photographic element as emulsified photographic dispersions prepared by dissolving the materials in one or more high-boiling permanent organic solvents, with or without a low-boiling or partially water-soluble auxiliary organic solvent. A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, as described in EP-A-1 037 103, incorporated herein by reference.

However it has been found in particular with cyan dye-forming couplers, such as those of formula (II), that it is particularly beneficial when the formulation includes an H-donor coupler solvent of general formula (V) to provide the desirable combination of dye hue and stability of the image dye to light fade.

(V)

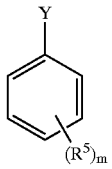

wherein each $R^5$ is a substituent and m is an integer of from 1 to 3 and the total number of the carbon atoms contained in all of the $R^5$ groups is at least 8; and Y is OH or $NHSO_2R'''$, wherein R''' is an unsubstituted or substituted alkyl or aryl group or a 5–10 membered heterocyclic ring which contains one or more heteroatoms selected from nitrogen, oxygen and sulfur, which ring is unsubstituted or substituted.

With such a solvent the absorption characteristics of the image dye are shifted to a more favourable region, and this effect has been found to be enhanced by the presence of a silicon compound. As an added advantage, the stabilization potential of the silicon compound is magnified in the presence of the coupler solvent.

The size of the substituent group(s) is influential in accomplishing both of these results. Suitably at least one of the groups, which may be the same or different, is an alkyl group or a substituted alkoxy group. Typical examples are a single alkyl group of 8 to 15 carbon atoms or two alkyl groups of 4 or 5 carbon atoms each.

Specific examples of solvents of formula (V) include the following although the invention is not to be construed as limited thereto:

(S1)

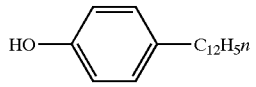

(S2)

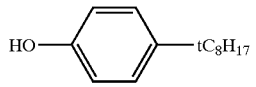

(S3)

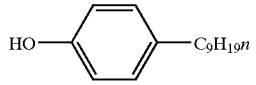

(S4)

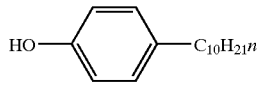

(S5)

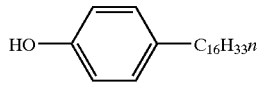

(S6)

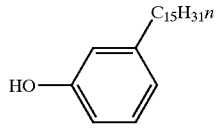

(S7)

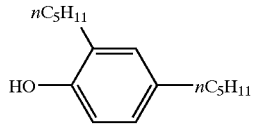

(S8)

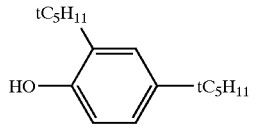

(S9)

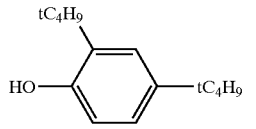

(S10)

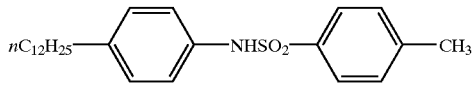

(S11)

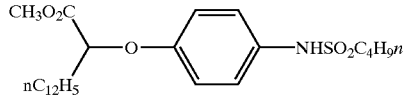

Suitable laydowns of any one of the couplers are from about 0.1 g/m$^2$ to about 2 g/m$^2$, preferably from about 0.2 g/m$^2$ to about 1.0 g/m$^2$. The ratio of stabilizer to coupler by weight in each single colour record is from about 0.1:1 to about 5:1, preferably from about 0.5:1 to about 2:1, but more preferably the stabilizer and coupler are in about equal amounts by weight. In any single colour record, the ratio of solvent to coupler by weight is from about 0.2:1 to about 4:1, preferably from about 0.5:1 to about 2:1.

Unless otherwise specifically stated or when the term "group" is used, it is intended throughout this specification, when a substituent group contains a substitutable hydrogen, to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentyl-phenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyl-oxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetra-decanamido, alpha-(2,4-di-t-pentyl-phenoxy)acetamido, alpha-(2,4-di-t-pentyl-phenoxy) butyramido, alpha-(3-pentadecylphenoxy)hexanamido, alpha-(4-hydroxy-3-t-butylphenoxy)-tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxy-carbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecyl-benzenesulfonamido, N-methyltetradecylsulfonamido, N,N-dipropylsulfamoyl-amino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutyl-carbamoyl, N-octadecylcarbamoyl, N-[4-(2,4-di-t-pentylphenoxy)butyl]-carbamoyl, N-methyl-N-tetradecylcarbamoyl, and N,N-dioctylcarbamoyl; acyl, such as acetyl, (2,4-di-t-amylphenoxy)acetyl, phenoxy-carbonyl, p-dodecyloxy-phenoxycarbonyl methoxycarbonyl, butoxycarbonyl, tetradecyloxycarbonyl, ethoxycarbonyl, benzyloxycarbonyl, 3-pentadecyloxy-carbonyl, and dodecyl-oxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentyl-phenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecyl-sulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenyl-carbamoyloxy, N-ethylcarbamoyloxy, and cyclohexylcarbonyloxy; amine, such as phenylanilino, 2-chloroanilino, diethyl-amine, dodecylamine; imino, such as 1N-phenylimido)ethyl, N-succinimido or 3-benzylhydantoinyl; phosphate, such as dimethylphosphate and ethylbutyl-phosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized colour developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobic or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Colour materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with colour reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and colour correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized colour developing agents which are described in such representative patents and publications as listed hereinbefore. Preferably such couplers are phenols, naphthols or pyrazoloazoles.

Couplers that form magenta dyes upon reaction with oxidized colour developing agent have been listed hereinbefore. Preferably such couplers are pyrazolones, pyrazolotriazoles, or pyrazolobenzimidazoles.

Couplers that form yellow dyes upon reaction with oxidized colour developing agent have been listed hereinbefore. Such couplers are typically open chain ketomethylene compounds.

Couplers that form colourless products upon reaction with oxidized colour developing agent are described in such representative patents as: UK. Patent No. 861,138; U.S. Pat.. Nos. 3,632,345, 3,928,041, 3,958,993 and 3,961,959. Typically such couplers are cyclic carbonyl containing compounds that form colourless products on reaction with an oxidized colour developing agent.

Couplers that form black dyes upon reaction with oxidized colour developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-amino-phenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2 - or 3- position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong"

coloured couplers (e.g. to adjust levels of interlayer correction) and, in colour negative applications, with masking couplers such as those described in EP 0 213 490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The materials for use in the invention may be used in association with materials that release "photographically useful groups" (PUGS) that accelerate or otherwise modify the processing steps e.g. of bleaching or fixing to improve the quality of the image. Bleach accelerator releasing couplers such as those described in EP 0 193 389; EP 0 301 477; U.S. Pat. Nos. 4,163,669; U.S. 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859, 578; 4,912,025); antifogging and anti colour-mixing agents such as derivatives of hydroquinones, aminophenols, amines, gallic acid; catechol; ascorbic acid; hydrazides; sulfonamidophenols; and non colour-forming couplers.

The materials for use in the invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556 and 4,543, 323.) Also, the compositions may be blocked or coated in protected form as described, for example, in Japanese Application 61/258,249 or U.S. Pat. No. 5,019,492.

The materials for use in the invention may further be used in combination with image-modifying compounds that release PUGS such as "developer inhibitor-releasing" compounds (DIRs). DIRs useful in conjunction with the compositions used in the invention are known in the art and examples are described in U.S. Pat. Nos. 3,137,578; 3,148, 022; 3,148,062; 3,227,554; 3,384,657; 3,379,529; 3,615, 506; 3,617,291; 3,620,746; 3,701,783; 3,733,201; 4,049, 455; 4,095,984; 4,126,459; 4,149,886; 4,150,228; 4,211, 562; 4,248,962; 4,259,437; 4,362,878; 4,409,323; 4,477, 563; 4,782,012; 4,962,018; 4,500,634; 4,579,816; 4,607, 004; 4,618,571; 4,678,739; 4,746,600; 4,746,601; 4,791, 049; 4,857,447; 4,865,959; 4,880,342; 4,886,736; 4,937, 179; 4,946,767; 4,948,716; 4,952,485; 4,956,269; 4,959, 299; 4,966,835; 4,985,336 as well as in patent publications GB 1,560,240; GB 2,007,662; GB 2,032,914; GB 2,099, 167; DE 2,842,063, DE 2,937,127; DE 3,636,824; DE 3,644,416 as well as the following European Patent Publications: 0 272 573; 0 335319; 0 336 411; 0 346 899; 0 362 870; 0 365 252; 0 365 346; 0 373 382; 0 376 212; 0 377 463; 0 378 236; 0 384 670; 0 396 486; 0 401 612; 0 401 613.

Such compounds are also disclosed in "Developer-Inhibitor-Releasing (DIR) Couplers for Colour Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulae:

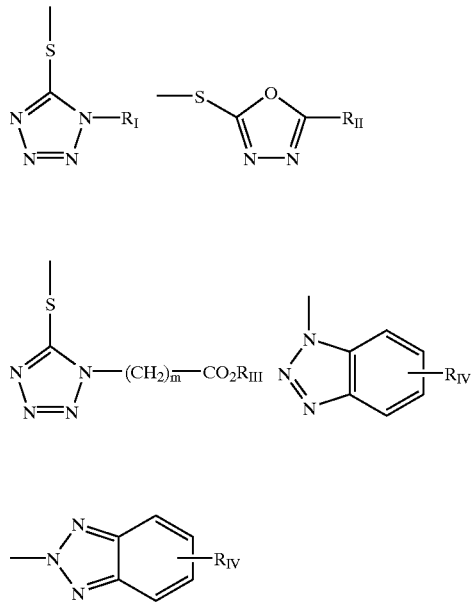

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulae:

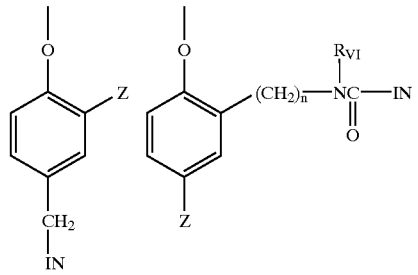

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

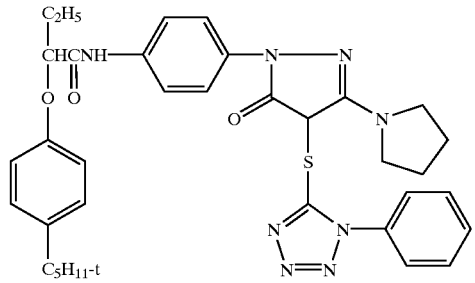

D2

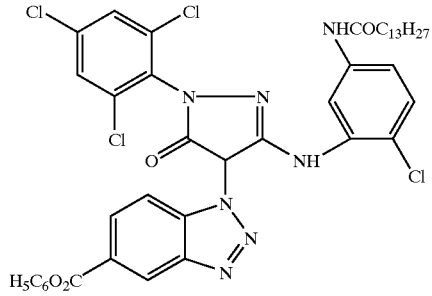

-continued

D3

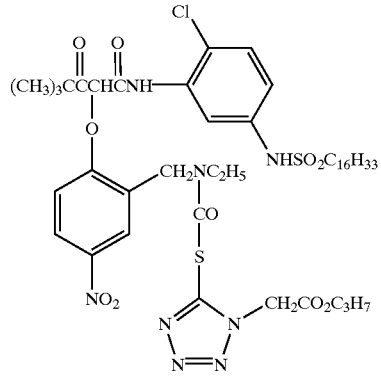

D4

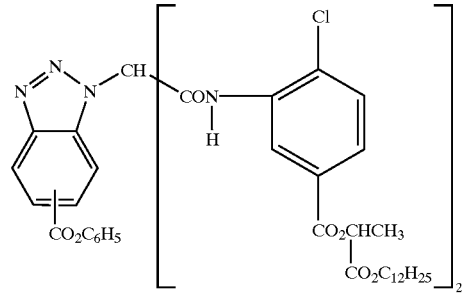

D5

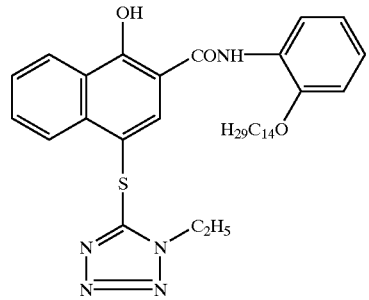

D6

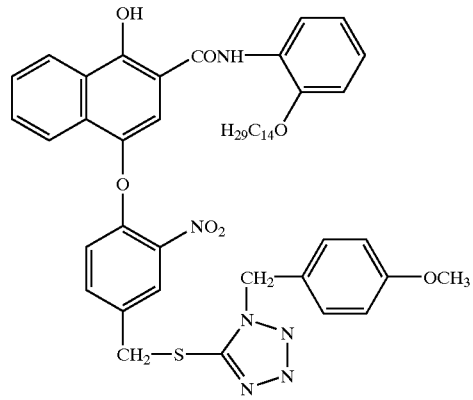

-continued

D7

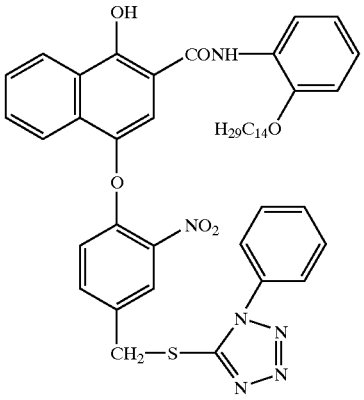

D8

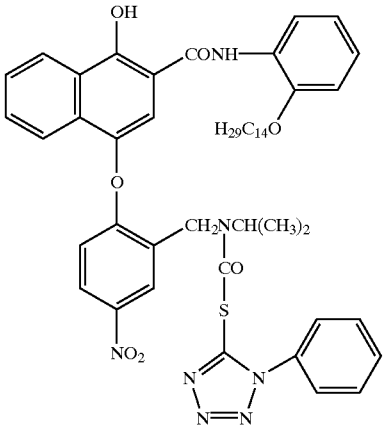

D9

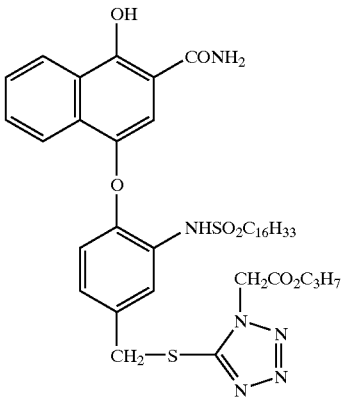

-continued

D10

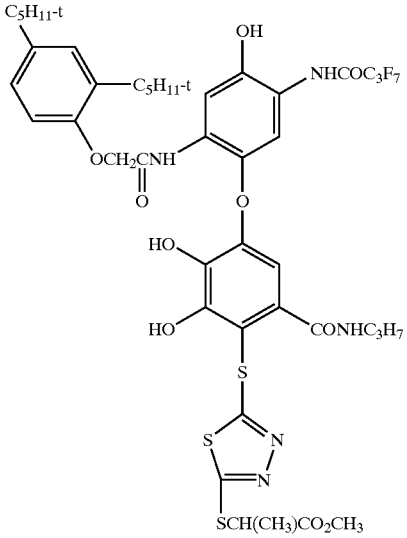

D11

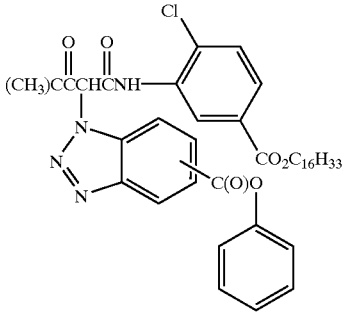

D12

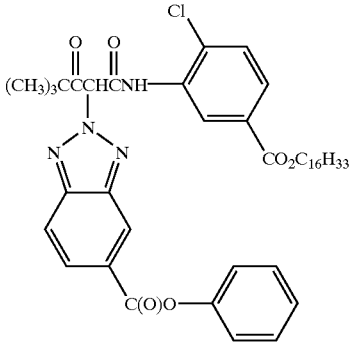

It is also contemplated that the concepts of the present invention may be employed to obtain reflection colour prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials for use in the invention may be coated on pH adjusted support as described in U.S. Pat. No. 4,917,994; on a support with reduced oxygen permeability (EP 0 553 339); with epoxy solvents (EP 0 164 961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Any silver halide combination can be used for the photographic element, such as silver chloride, silver chlorobromide, silver chlorobromo-iodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment as described in EP-A-1 037 103, incorporated herein by reference.

Tabular grain silver halide emulsions can be used in this invention. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. One type of such element, referred to as a colour negative film, is designed for image capture. Speed (the sensitivity of the element to low light conditions) is usually critical to obtaining sufficient image in such elements. Such elements are typically silver bromoiodide emulsions and may be processed, for example, in known colour negative processes such as the Kodak C-41™ process as described in The British Journal of Photography Annual of 1988, pages 191–198. If a colour negative film element is to be subsequently employed to generate a viewable projection print as for a motion picture, a process such as the Kodak ECN-2™ process described in the H-24 Manual available from Eastman Kodak Co. may be employed to provide the colour negative image on a transparent support. Colour negative development times are typically 3 min. 15 sec. or less and desirably 90 or even 60 sec. or less.

The photographic element of the invention can be incorporated into exposure structures intended for repeated use or exposure structures intended for limited use, variously referred to by names such as "single use cameras", "lens with film" or "photosensitive material package units".

Another type of colour negative element is a colour print. Such an element is designed to receive an image optically printed from an image capture colour negative element. A colour print element may be provided on a reflective support for reflective viewing (e.g. a snap shot) or on a transparent support for projection viewing as in a motion picture. Elements destined for colour reflection prints are provided on a reflective support, typically paper, employ silver chloride emulsions, and may be optically printed using the so-called negative-positive process where the element is exposed to light through a colour negative film which has been processed as described above. The print may then be processed to form a positive reflection image using, for example, the Kodak RA-4™ process as described in The British Journal of Photography Annual of 1988, pp 198–199. Colour projection prints may be processed, for example, in accordance with the Kodak ECP-2™ process as described in the H-24 Manual. Colour print development times are typically 90 sec. or less and desirably 45 or even 30 sec. or less.

A reversal element is capable of forming a positive image without optical printing. To provide a positive (or reversal) image, the colour development step is preceded by development with a non-chromogenic developing agent to develop exposed silver halide, but not form dye, and followed by uniformly fogging the element to render unexposed silver halide developable. Such reversal emulsions are typically sold with instructions to process using a colour reversal process such as the Kodak E-6™ process. Alternatively, a direct positive emulsion can be employed to obtain a positive image.

The above emulsions are typically sold with instructions to process using the appropriate method such as the mentioned colour negative (Kodak C-41™), colour print (Kodak RA-4™), or reversal (Kodak E-6™) process.

Preferred colour developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

The following examples illustrate the preparation and photographic use of the compounds of the invention. It is to be understood that the invention is not limited to the chosen examples.

The synthesis of the cyan, magenta and yellow dye-forming couplers is well described in the literature. For example the synthesis of the cyan dye-forming coupler of formula (II), C-1, is disclosed in U.S. Pat. No. 6,004,738. Magenta dye-forming couplers of formulae (III) may be prepared according to the methods described in EP-A-0 602 751 (M-1), JP 04041488 (M-2) and EP-A-0 47 170 (M-3). The synthesis of yellow dye-forming coupler (Y-1) of formula (IV) is described in DDR Patentschrift No. 269 697.

All the coupler solvents of formula (V) used in this invention were available either commercially or prepared using standard techniques.

The bisphenol derivative stabilizer compounds are prepared from the corresponding bisphenol by the scheme below:

Example 1

Synthesis of Stabilizer ST3

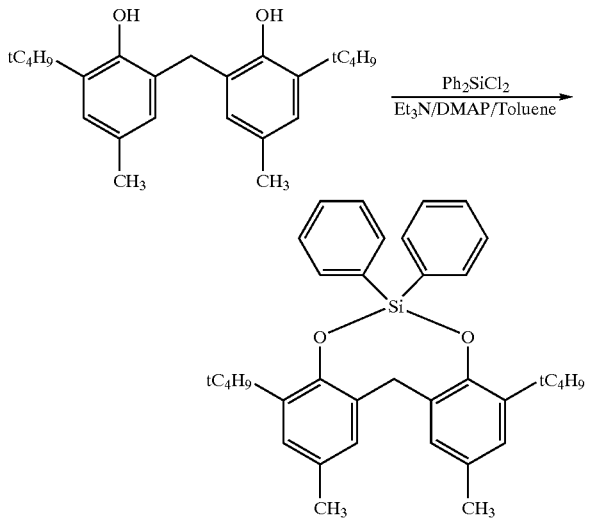

A solution of commercially available bis-phenol (34.0 g, 0.1 mol) in toluene (250 ml) was stirred in an acetone-ice bath with triethylamine (21 g, 0.2 mol) and a catalytic quantity of 4-dimethylaminopyridine (DMAP) (1 g). The dichlorosilane (30.4 g, 0.12 mol) in toluene (60 ml) was dripped in over 30 min., the ice bath removed and the solution stirred at room temp for 1 h. During this time much triethylamine HCl salt precipitated out and this was removed by filtration. The filtrate was evaporated to dryness in vacuo then the orange viscous oily residue was taken up in ethyl acetate (300 ml) and washed with water. After drying over $MgSO_4$, the organic layer was evaporated to give the crude product as an orange coloured oil which gave a cream solid on trituration with acetonitrile. The solid was collected by filtration and crystallised further from methanol to give the final product as a white crystalline solid, 36.5 g (70%), m.p.=139–140 C.

GC/MS—shows one component only consistent with product (molecular ion m/z 520).

Calcd. For $C_{35}H_{40}O_2Si$; C, 80.7; H, 7.7%.

Found: C, 80.7; H, 7.8%.

Other stabilizers can be prepared accordingly by appropriate choice of bisphenol starting material.

Photographic Examples

Example 2

Cyan Coatings (a)

Preparation of Photographic Elements

Example coupler C-1 was dispersed in gelatin according to the following procedure:

Coupler C-1 (5.59 g, 6.88 mmol) was dissolved in a mixture of coupler solvent S1 (2.8 g) and ethyl acetate (2 g) and the mixture was heated to effect solution. After adding aqueous gelatin (40 g, 10%), containing 0.25% di-isopropylnaphthalene sulfonic acid (sodium salt) surfactant, at 60 C., the mixture was dispersed by ultrasonic agitation for 2 min. using a Dawe Instruments "Soniprobe" and diluted to 60 g with water.

A second dispersion of coupler C-1 was prepared as above, but with comparison stabilizer C-ST1 (5.59 g) added to the oil solution. In these dispersions, the quantity of coupler solvent S1 was also increased to 5.59 g. A further eight dispersions were likewise prepared, except that the comparison stabilizer was replaced by the same weight of individual stabilizers ST1-ST8 according to the invention, as indicated in TABLE 1 below.

CST-1

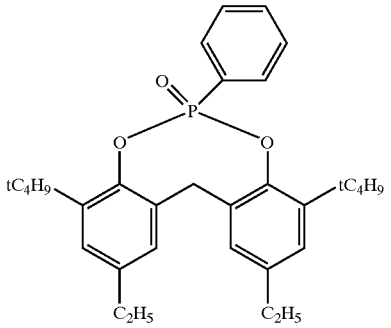

Each of the above dispersions was mixed with an appropriate quantity of a red-sensitive cubic silver chloride photographic emulsion (average edge length: 0.36 $\mu$m) and further diluted to 300 g with aqueous gelatin preparatory to being coated on a resin-coated paper support carrying a pre-coated gel pad (3 $g.m^{-2}$). A protective gelatin supercoat (1.0 $g.m^{-2}$), containing an appropriate quantity of bis-(vinylsulfonylmethane) hardener, was applied over the photo-sensitive layer. The silver and coupler coverages were, respectively, 0.21 $g.m^{-2}$ and 0.831 $mmol.m^{-2}$.

The full coating structure is shown below.

| | | |
|---|---|---|
| Gel | 1.0 $g.m^{-2}$ | GEL SUPERCOAT |
| Hardener* | 0.084 $g.m^{-2}$ | |
| Coupler | 0.831 $mM.m^{-2}$ | PHOTOSENSITIVE LAYER |
| Ag | 0 .21 $g.m^{-2}$ | |
| Gel | 1.615 $g.m^{-2}$ | |
| Gel | 3.0 $g.m^{-2}$ | GEL PAD |

Resin Coated Paper
*Hardener = bis(vinylsulfonylmethane)

Processing and Evaluation

Sample strips of the coatings were exposed through a step tablet (density range 0–3, 0.15 inc.) and developed through standard KODAK RA4™ process solutions. Sensitometric curves were generated for each coating and the spectral absorption characteristics of the image dyes were also measured using a spectrophotometer operating in reflection mode. The light stability of the image dyes was assessed using standard simulated daylight fading equipment incorporating a Xenon arc source, delivering an exposure intensity of 50 klx at the sample plane. The sample strips were mounted in the fader under a uv-absorbing filter, comprising Tinuvin-328™ (Ciba-Geigy), dispersed in gelatin and coated on a transparent polyester sheet at a coverage of 1.0 $g.m^{-2}$. At the end of these tests, the sensitometric curves were re-read and status "A" red density losses from an initial value of 1.0 were recorded.

The results are reproduced in TABLE 1, which shows the maximum density and contrast ($\gamma$), read from the initial sensitometric curves for each of the coatings, as well as the density loss from 1.0 during the light fade experiment. The initial sensitometric parameters provide a measure of coupling activity. The wavelength of maximum absorption of the image dye, read from the measured spectral absorption curves, is also included in the table to give a convenient representation of the image dye hue.

TABLE 1

Sensitometry, Image Dye Hue and Stability Data

| Coated Dispersion | $\lambda_{max}$ (nm) | $D_{max}$ | $\gamma$ | Light Stability* $\Delta D_{(1.0)}$ | |
|---|---|---|---|---|---|
| 1. C-1/S1 (comp.) | 663.2 | 2.284 | 3.111 | −0.22 | |
| 2. C-1/C-ST1/S1 (comp.) | 658.7 | 2.020 | 2.396 | −0.13 | |
| 3. C-1/ST1/S1 | 666.5 | 2.482 | 2.756 | −0.08 | (inv.) |
| 4. C-1/ST2/S1 | 665.1 | 2.263 | 3.254 | −0.08 | (inv.) |
| 5. C-1/ST3/S1 | 665.5 | 2.583 | 3.177 | −0.09 | (inv.) |
| 6. C-1/ST4/S1 | 665.4 | 2.311 | 2.463 | −0.10 | (inv.) |
| 7. C-1/ST5/S1 | 663.8 | 2.346 | 2.945 | −0.11 | (inv.) |
| 8. C-1/ST6/S1 | 663.1 | 2.517 | 2.858 | −0.10 | (inv.) |
| 9. C-1/ST7/S1 | 662.5 | 2.425 | 2.854 | −0.11 | (inv.) |
| 10. C-1/ST8/S1 | 664.1 | 2.294 | 3.055 | −0.09 | (inv.) |

*4 wk, 50 klx Fade, $\Delta D_{(1.0)}$ = Density loss from 1.0

The results show very clearly that, relative to the unstabilized check coating (sample 1), the coating containing the comparison phosphorus stabilizer (C-ST1) (sample 2) showed a decrease in coupling activity as indicated by lower contrast and maximum density. The stabilizers (ST1–ST8) used in the invention showed improved coupling activity relative to the comparison stabiliser C-ST1. They also exhibited image dye hues that were substantially deeper than that of the corresponding coating containing C-ST1. The image dye hue was, in fact, in most cases deeper than that obtained from the check coating of the coupler alone. It is also clear that the presence of stabilizers ST1–ST8 improves image dye light stability more effectively than does the comparison stabilizer C-ST1.

Example 3

Cyan Coatings (b)

Preparation of Photographic Elements

Three dispersions of the coupler C-2 with and without the stabilizers C-ST1 and ST1 were prepared and coated according to the procedures described in Example 2. Similar dispersions of coupler C-3 with and without the stabilizers C-ST1 and ST6 were also prepared and coated. Additional coatings were made from two co-dispersions of the alternative example coupler C-4 with the stabilizers C-ST1 or ST1. The composition of the oil phases of these dispersions is indicated below:

1. C-2 (5.06 g, 6.88 mmol)+S1 (2.53 g)+ethyl acetate (2.0 g)
2. C-2 (5.06 g, 6.88 mmol)+C-ST1 (5.06 g)+S1 (5.06 g)+ethyl acetate (2.0 g)
3. C-2 (5.06 g, 6.88 mmol)+ST1 (5.06 g) S1 (5.06 g)+ethyl acetate (2.0 g)
4. C-3 (5.30 g, 6.88 mmol)+S1 (2.15 g)+ethyl acetate (2.0 g)
5. C-3 (5.30 g, 6.88 mmol)+C-ST1 (5.30 g)+S1 (5.30 g)+ethyl acetate (2.0 g)
6. C-3 (5.30 g, 6.88 mmol)+ST6 (5.30 g)+S1 (5.30 g)+ethyl acetate (2.0 g)
7. C-4 (5.52 g, 6.88 mmol)+C-ST1 (5.52 g)+S1 (5.52 g)+ethyl acetate (2.0 g)
8. C-4 (5.52 g, 6.88 mmol)+ST1 (5.52 g)+S1 (5.52 g)+ethyl acetate (2.0 g)

Processing and Evaluation

The resultant coatings were processed as described in Example 2 to provide sample strips for image stability and hue evaluation. The test procedures matched those described in Example 2, except that the light stability test was extended to 6 weeks.

TABLE 2

Image Dye Hue and Stability Data

| Coated Dispersion | $\lambda_{max}$ (nm) | $D_{max}$ | γ | Light Stability* $\Delta D_{(1.0)}$ | |
|---|---|---|---|---|---|
| 1. C-2/S1 | 663.1 | 2.426 | 3.298 | −0.27 | |
| 2. C-2/C-ST1/S1 | 658.3 | 2.405 | 2.847 | −0.16 | (comp.) |
| 3. C-2/ST1/S1 | 663.9 | 2.533 | 3.123 | −0.12 | (inv.) |
| 4. C-3/S1 | 664.2 | 1.949 | 2.266 | −0.30 | |
| 5. C-3/C-ST1/S1 | 660.2 | 2.034 | 2.244 | −0.13 | (comp) |
| 6. C-3/ST6/S1 | 665.3 | 2.136 | 2.525 | −0.09 | (inv.) |
| 7. C-4/C-ST1/S1 | 662.9 | 2.231 | 2.570 | −0.18 | (comp) |
| 8. C-4/ST1/S1 | 670.3 | 2.367 | 2.651 | −0.14 | (inv.) |

*6 wk, 50 klux Fade, ΔD = Density loss from 1.0, P/O = $D_{min}$ yellowing

These results show that the silicon stabilizer used in this invention, ST1, was superior to the comparison phosphorus stabilizer, C-ST1, in reducing the light-induced density loss from the image dyes of couplers C-2 and C-4. It also provided a higher contrast image and gave a more acceptable (deeper) image dye hue than the phosphorus compound. The combination of stabilizer ST6 with coupler C-3 is similarly advantageous.

Example 4

Cyan Coatings (c)

Preparation of Photographic Elements

Further dispersions of the example coupler C-1 were prepared and coated according to the procedures outlined in Example 2. The respective oil phases of these dispersions were made up as follows:

1. C-1 (5.59 g, 6.88 mmol)+dBP (2.80 g)+ethyl acetate (2.0 g)
2. C-1 (5.59 g, 6.88 mmol)+C-ST1 (5.59 g)+dBP (5.59 g)+ethyl acetate (2.0 g)
3. C-1 (5.59 g, 6.88 mmol)+ST1 (5.59 g)+dBP (5.59 g)+ethyl acetate (2.0 g)

Except for the use of dibutyl phthalate (dBP) as coupler solvent instead of phenolic solvent S1, these dispersions thus replicated samples 1,2 and 3 (TABLE 1) from Example 2.

Processing and Evaluation

The resultant coatings were processed as described in Example 2 to provide sample strips for image stability and hue evaluation. The test procedures matched those described in Example 2. TABLE 3 summarizes the results that were obtained.

TABLE 3

Image Dye Hue and Stability Data

| Coated Dispersion | $\lambda_{max}$ (nm) | $D_{max}$ | γ | Light Stability* $\Delta D_{(1.0)}$ | |
|---|---|---|---|---|---|
| 1. C-1/dBP | 651.6 | 2.565 | 3.153 | −0.16 | |
| 2. C-1/C-ST1/dBP (comp.) | 645.7 | 2.697 | 3.062 | −0.12 | |
| 3. C-1/ST1/dBP | 647.5 | 2.870 | 3.236 | −0.13 | (inv.) |

*4 wk, 50 klx Fade, ΔD = Density loss from 1.0, P/O = $D_{min}$ yellowing

These results demonstrate that, compared with the comparison phosphorus stabilizer C-ST1, the silicon stabilizer ST1 used in this invention, when used in conjunction with coupler C-1 and with dBP as coupler solvent, gave a higher contrast image with an improved (slightly deeper) hue and had comparable effectiveness as a light stabilizer. However, the extent of the improvement was significantly smaller than that seen in Example 2, when S1 was used as the coupler solvent.

Example 5

Yellow Coatings

Preparation of Photographic Elements

Utilising the technique described in Example 2, a dispersion of the yellow pivaloylacetanilide coupler Y-1 (4.23 g, 4.65 mmol) was also prepared, using dBP as coupler solvent at 0.46× (w/w) with respect to the coupler.

A second dispersion of the coupler was prepared in the same way, except that the stabilizer ST1 (1.36 g, 2.32 mmol) was included with the coupler. Two further comparable dispersions were also prepared in which the stabilizer ST1 was replaced independently by the comparison stabilizers C-ST2 or C-ST3 at the same molar concentration.

CST-2

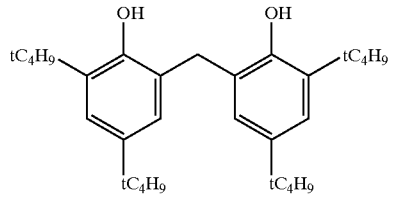

CST-3

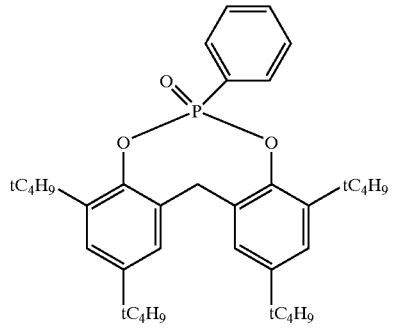

Each of these dispersions was coated according to the procedure described in Example 2, except that a silver chlorobromide (80% Br) photographic emulsion was used instead of the pure chloride emulsion and the silver coverage was increased to 0.40 $g.m^{-2}$.

Processing and Evaluation

After exposure as described in Example 2, the coatings were developed in a standard Kodak EP2™ process cycle and the processed strips were evaluated as described in Example 2, except that Status "A" Blue density measurements were recorded and image dye light stability was assessed at an intensity of 5.4 klx instead of 50 klx. The results obtained are summarised in TABLE4.

TABLE 4

Image Dye Hue and Stability Data

| Coated Dispersion | $\lambda_{max}$ (nm) | γ | Light Stability* $\Delta D_{(1.0)}$ | |
|---|---|---|---|---|
| 1. Y-1/dBP | 442.6 | 2.792 | −0.15 | |
| 2. Y-1/ST1/dBP | 442.5 | 2.687 | −0.09 | (inv.) |
| 3. Y-1/C-ST2/dBP (comp.) | 443.6 | 2.735 | −0.12 | |
| 4. Y-1/C-ST3/dBP (comp.) | 442.3 | 2.634 | −0.08 | |

*6 wk, 5.4 klx Fade, ΔD = Density loss from 1.0

These results demonstrate that the heterocyclic silicon stabilizer ST1 used in this invention was also an effective stabilizer for yellow image dyes, with comparable or better performance than previously known materials. Relative to the comparable phosphorus stabilizer, C-ST3, there was also a small improvement in coupling reactivity, indicated by the higher contrast (γ) of the ST1 coating, but the wavelength of the image dye absorption band was not greatly affected by either stabiliser in this instance.

Example 6

Magenta Coatings

Preparation of Photographic Elements

Utilising the technique described in Example 6, a dispersion of the magenta pyrazolotriazole coupler M-1 (3.12 g, 4.87 mmol) was prepared, using dBP as coupler solvent at 0.5× (w/w) with respect to coupler.

A further dispersion of the coupler was prepared in the same way, except that stabilizer ST2 (3.12 g, 5.69 mmol) was included with the coupler and the dBP level was increased to 3.12 g. In an otherwise identical third dispersion, the stabilizer S2 was replaced by the comparison stabilizer C-ST1 at the same concentration by weight.

Two further trios of dispersions were prepared to the same formulations using, respectively, the alternative pyrazolotriazole coupler M-2 (2.35 g, 4.87 mmol) and the pyrazolone coupler M-3 (3.87 g, 4.87 mmol).

Processing and Evaluation

Each of these dispersions was coated, exposed and processed according to the procedures described in Example 2. The processed strips were also evaluated as described in Example 2, except that Status "A" Green density measurements were recorded to monitor sensitometric performance, and light stability was assessed after fading for one week only. The results obtained are summarised in TABLE 5.

TABLE 5

Image Dye Hue and Stability Data

| Coated Dispersion | $\lambda_{max}$ (nm) | Light Stability* ΔD | |
|---|---|---|---|
| 1. M-1/dBP | 546.8 | −0.22 | |
| 2. M-1/ST2/dBP | 545.0 | −0.08 | (inv) |
| 3. M-1/C-ST1/dBP | 547.1 | −0.16 | (comp) |
| 4. M-2/dBP | 538.3 | −0.74 | |
| 5. M-2/ST2/dBP | 543.2 | −0.52 | (inv) |
| 6. M-2/C-ST1/dBP | 544.4 | −0.57 | (comp) |
| 7. M-3/dBP | 538.7 | −0.16 | |
| 8. M-3/ST2/dBP | 536.2 | −0.14 | (inv) |
| 9. M-3/C-ST1/dBP | 536.3 | −0.17 | (comp) |

*1 wk, 50 klx Fade, ΔD = Density loss from 1.0

These results demonstrate that the heterocyclic silicon stabilizer ST2 was also a particularly effective stabilizer for the magenta image dye from coupler M-1 and was a superior stabilizer to the comparison stabilizer C-ST1 for the dyes from couplers M-2 and M-3.

The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer having associated therewith one or more dye-forming couplers and a stabilizer compound of formula (I):

(I)

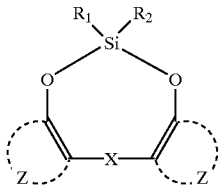

wherein $R_1$ and $R_2$ are independently selected from hydrogen or an unsubstituted or substituted alkyl, aryl, alkoxy, aryloxy or amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene rings or heteroaromatic ring systems; or X forms, together with substituents ortho to X on the arene rings or heteroaromatic ring systems, a fused unsubstituted or substituted 5-, 6- or 7-membered ring, which may contain one or two heteroatoms selected from nitrogen, oxygen and sulfur.

2. The photographic element of claim 1 wherein the stabilizer compound has the formula (IA)

(IA)

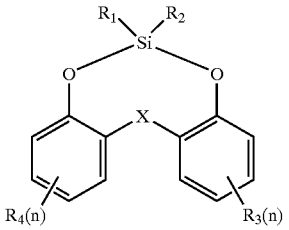

wherein $R_1$ and $R_2$ are independently selected from hydrogen or an unsubstituted or substituted alkyl, aryl, alkoxy, aryloxy or amino group or may combine to complete a 5–10 membered heterocyclic ring which may contain in addition to the silicon atom one or more heteroatoms selected from nitrogen, oxygen and sulfur, which ring is unsubstituted or substituted;

$R_3$ and $R_4$ are each independently selected from halogen or an unsubstituted or substituted alkyl, aryl, alkoxy, aryloxy, COOR or CONR'R" group, where R is an unsubstituted or substituted alkyl or aryl group and R' and R" are independently selected from hydrogen and an unsubstituted or substituted alkyl or aryl group and each n is independently an integer from 1 to 4;

X is a single bond or a linking group having a single atom which connects the two phenyl rings; or X forms together with $R_3$ and $R_4$, when in the ortho position, a fused unsubstituted or substituted 5-, 6- or 7-membered ring, which may contain one or two heteroatoms selected from nitrogen, oxygen and sulfur.

3. The photographic element of claim 2 wherein the stabilizer compound has the formula (IB)

(IB)

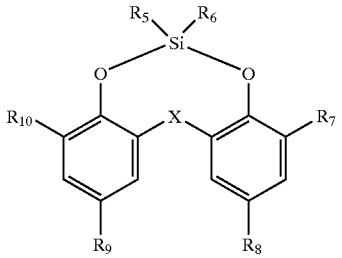

wherein:

$R_5$ and $R_6$ are independently selected from hydrogen, and unsubstituted or substituted alkyl or aryl groups, or they may combine with the silicon atom to form a five- or six-membered ring, which may contain an oxygen atom;

$R_7$, $R_8$, $R_9$ and $R_{10}$ are independently selected from halogen atoms or unsubstituted or substituted alkyl or alkoxy groups; and X is a single bond or a linking group having a single atom which connects the phenyl rings.

4. The photographic element of claim 1 wherein X is a divalent linking group selected from —CR'R"—, —NR—, —$S(O)_q$— and —O—, wherein R is an unsubstituted or substituted alkyl or aryl group and R' and R" are independently selected from hydrogen and an unsubstituted or substituted alkyl or aryl group, and q is 0,1 or 2.

5. The photographic element of claim 4 wherein X is an unsubstituted or substituted methylene group or a sulfur or oxygen atom.

6. The photographic element of claim 1 wherein the stabilizer compound is selected from one of the following formulae:

(ST1)

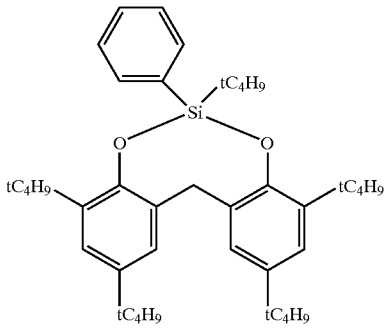

(ST2)

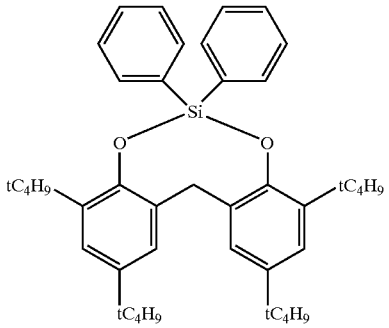

-continued (ST3)

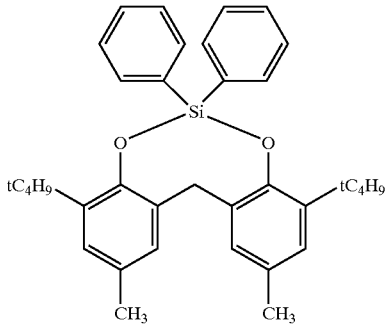

(ST4)

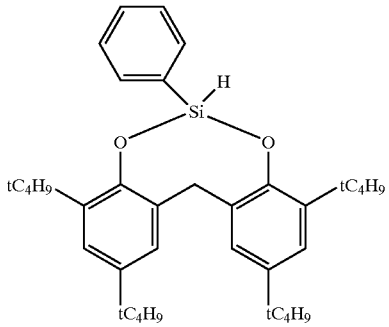

(ST5)

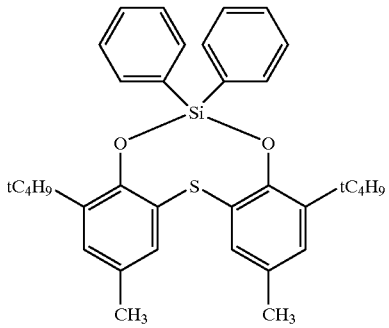

(ST6)

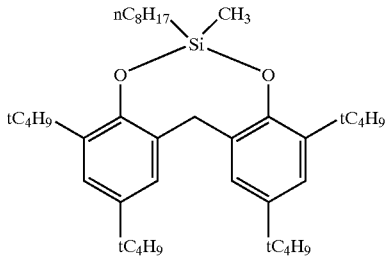

(ST7)

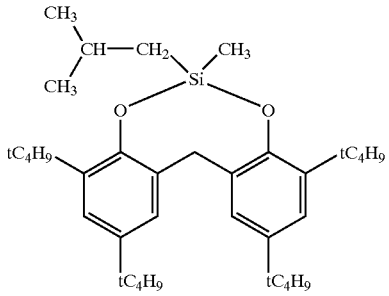

-continued (ST8)

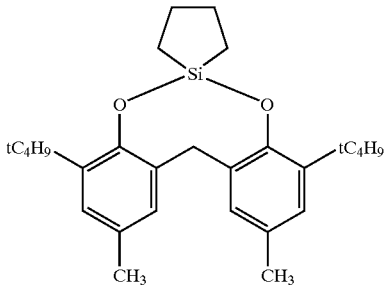

7. The photographic element of claim 1 wherein the silver halide emulsion layer has associated therewith a cyan dye-forming coupler of formula (II):

(II)

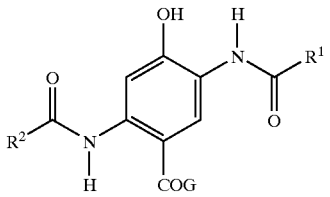

wherein $R^1$ and $R^2$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent.

8. The photographic element of claim 7 wherein $R^1$ is an aryl or heterocyclic ring which is unsubstituted or substituted with an electron-withdrawing substituent meta and/or para to the amido group and $R^2$ is the group

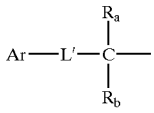

wherein

Ar is an unsubstituted or substituted aryl group,

L' is a divalent linking group selected from —O—, —SO—, or —$SO_2$—, and $R_a$ and $R_b$ are independently H or an alkyl group.

9. The photographic element of claim 1 wherein the silver halide emulsion layer has associated therewith a magenta dye-forming coupler of formula (IIIA) or (IIIB):

(IIIA)

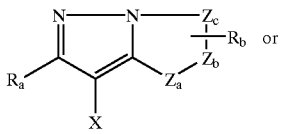

-continued (IIIB)

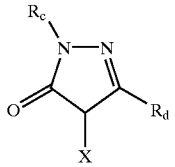

wherein $R_a$ and $R_b$ are independently hydrogen or a substituent;

$R_c$ and $R_d$ are independently selected substituents;

X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_a$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

10. The photographic element of claim 1 wherein the silver halide emulsion layer has associated therewith a yellow dye-forming coupler of formula (IV):

(IV)

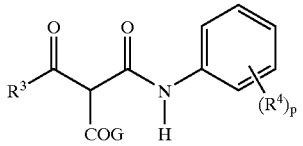

wherein $R^3$ is selected from an unsubstituted or substituted alkyl or aryl group or a 5–10 membered heterocyclic ring which contains one or more heteroatoms selected from nitrogen, oxygen and sulfur, which ring is unsubstituted or substituted;

COG is a hydrogen atom or a group which can be split off by the reaction of the coupler with an oxidized colour developing agent;

$R^4$ is a substituent; and p is 1 to 5.

11. The photographic element of claim 10 wherein $R^3$ is a tertiary alkyl group and each $R^4$ is independently selected from halogen, cyano, alkoxy, aryloxy, alkoxycarbonyl, alkylsulfamoyl, alkylsulfonamido, alkylsulfonyl, carbamoyl, alkylcarbamoyl or alkylcarbonamido.

12. The photographic element of claim 7 wherein the coupler solvent for the cyan dye-forming coupler of formula (II) has the formula (V)

(V)

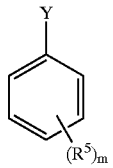

wherein each $R^5$ is a substituent and m is an integer of from 1 to 3 and the total number of the carbon atoms contained in all of the $R^5$ groups is at least 8; and Y is OH or $NHSO_2R'''$, wherein R''' is an unsubstituted or substituted alkyl or aryl group or a 5–10 membered heterocyclic ring which contains one or more heteroatoms selected from nitrogen, oxygen and sulfur, which ring is unsubstituted or substituted.

13. The photographic element of claim 1 wherein the ratio by weight of stabilizer to dye-forming coupler in a single colour record is from about 0.1:1 to about 5:1.

14. The photographic element of claim 13 wherein the stabilizer and dye-forming coupler in a singe colour record are in equal amounts by weight.

15. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises a light sensitive silver halide emulsion layer having associated therewith one or more dye-forming couplers and a stabilizer compound of formula (I):

(I)

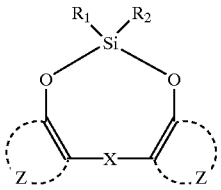

wherein $R_1$ and $R_2$ are independently selected from hydrogen or an unsubstituted or substituted alkyl, aryl, alkoxy, aryloxy or amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene rings or heteroaromatic ring systems; or X forms, together with substituents ortho to X on the arene rings or heteroaromatic ring systems, a fused unsubstituted or substituted 5-, 6- or 7-membered ring, which may contain one or two heteroatoms selected from nitrogen, oxygen and sulfur.

16. A process of forming an image in a photographic element after the element has been imagewise exposed to light, comprising contacting an element with a colour developing agent wherein the element comprises a light sensitive silver halide emulsion layer having associated therewith one or more dye-forming couplers and a stabilizer compound of formula (I):

(I)

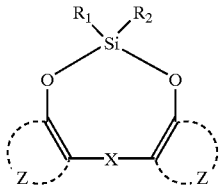

wherein $R_1$ and $R_2$ are independently selected from hydrogen or an unsubstituted or substituted alkyl, aryl, alkoxy, aryloxy or amino group or may combine to complete a 5–10 membered heterocyclic ring which may contain in addition to the silicon atom one or more heteroatoms selected from nitrogen, oxygen and sulfur, which ring is unsubstituted or substituted;

each Z independently represents the atoms necessary to complete a substituted or unsubstituted arene or heteroaromatic ring system;

X is a single bond or a linking group having a single atom which connects the arene rings or heteroaromatic ring systems; or X forms, together with substituents ortho to X on the arene rings or heteroaromatic ring systems, a fused unsubstituted or substituted 5-, 6- or 7-membered ring, which may contain one or two heteroatoms selected from nitrogen, oxygen and sulfur.

* * * * *

UNITED STATES PATENT AND TRADEMARK OFFICE

CERTIFICATE OF CORRECTION

PATENT NO. : 6,444,412 B1 
DATED : September 3, 2002
INVENTOR(S) : David Clarke, Llewellyn J. Leyshon and Christopher Moore It is certified that error appears in the above-identified patent and that said Letters Patent is hereby corrected as shown below:

Column 49,
Lines 55-65, delete Structure "(ST2)" and insert the following Structure "(ST2)"

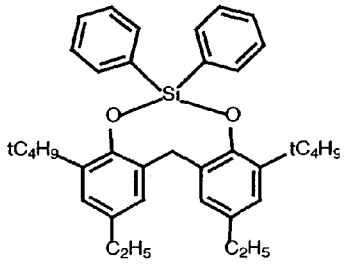

(ST2)

Signed and Sealed this

Twenty-ninth Day of July, 2003

JAMES E. ROGAN
*Director of the United States Patent and Trademark Office*